United States Patent [19]

Shinoda et al.

[11] Patent Number: 4,657,471

[45] Date of Patent: Apr. 14, 1987

[54] LOAD LIFTING UNIT FOR A LIFT TRUCK

[75] Inventors: Akibumi Shinoda, Handa; Yukio Yoshioka, Ohbu; Akio Kato, Kariya, all of Japan

[73] Assignee: Kabushiki Kaisha Toyoda Jidoshokki Seisakusho, Aichi, Japan

[21] Appl. No.: 838,897

[22] Filed: Mar. 11, 1986

Related U.S. Application Data

[60] Continuation of Ser. No. 660,944, Oct. 15, 1984, abandoned, which is a division of Ser. No. 424,100, Sep. 27, 1982, Pat. No. 4,505,635, which is a continuation of Ser. No. 189,838, Apr. 14, 1980, abandoned.

[30] Foreign Application Priority Data

| | | | |
|---|---|---|---|
| Aug. 17, 1978 | [JP] | Japan | 53-100137 |
| Mar. 20, 1979 | [JP] | Japan | 54-32925 |
| Mar. 21, 1979 | [JP] | Japan | 54-32978 |
| Mar. 22, 1979 | [JP] | Japan | 54-33989 |
| Mar. 22, 1979 | [JP] | Japan | 54-33990 |
| Mar. 23, 1979 | [JP] | Japan | 54-34541 |
| Mar. 23, 1979 | [JP] | Japan | 54-34542 |
| Mar. 27, 1979 | [JP] | Japan | 54-36673 |
| Mar. 27, 1979 | [JP] | Japan | 54-36674 |
| Apr. 11, 1979 | [JP] | Japan | 54-44780 |

[51] Int. Cl.[4] ..... B66F 9/08

[52] U.S. Cl. ..... 414/663; 414/667; 187/9 E

[58] Field of Search ..... 187/9 R, 9 E; 414/677, 414/663, 607

[56] References Cited

U.S. PATENT DOCUMENTS 3,394,778 7/1968 Brinton ..... 187/9 E

*Primary Examiner*—Terrance L. Siemens

*Attorney, Agent, or Firm*—Burgess, Ryan & Wayne

[57] ABSTRACT

The present invention discloses a load lifting unit for a lift truck, and more particularly, an improved structure of a load lifting unit for a counterbalance type lift truck. In the invention, to increase the loading capacity and longitudinal stability of the lift truck as well as to improve the forward view from the lift truck, two lift cylinders (7) are separately disposed on the sides of a pair of upright assemblies (1) of the load lifting unit, respectively, to provide a space (17) between the upright assemblies for allowing a lift member (4) to be lifted and lowered within the space and for allowing actuating means of various operations attachments engaged with the lift member to be accommodatedly arranged within the space.

4 Claims, 44 Drawing Figures

1
101
102
103
105
15
16
12
13
11
8
14
23
7
18a
4
19a
30
22a
31
104a
107
108

1
101
102
103
15
16
68
64
59
38a
105
41a
6
13
12
11
8
58
14
23
7
22
104
150
42a
60
56a
110a
34
4
69
17
106

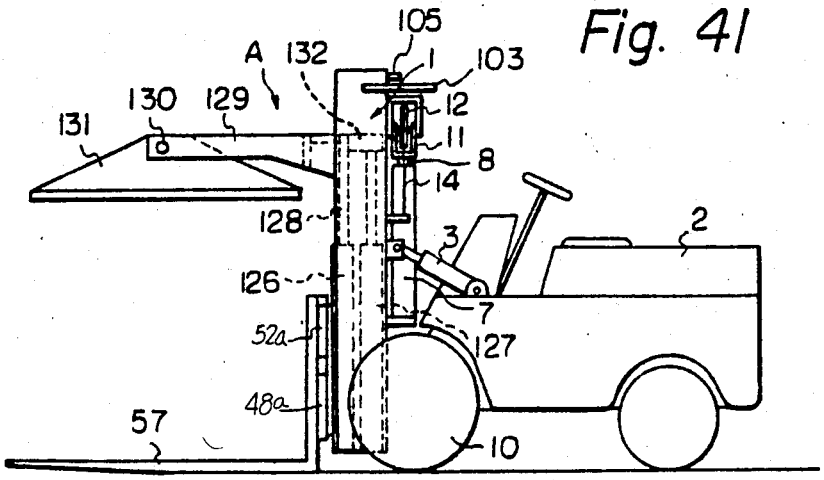
Fig. 41
Fig. 42
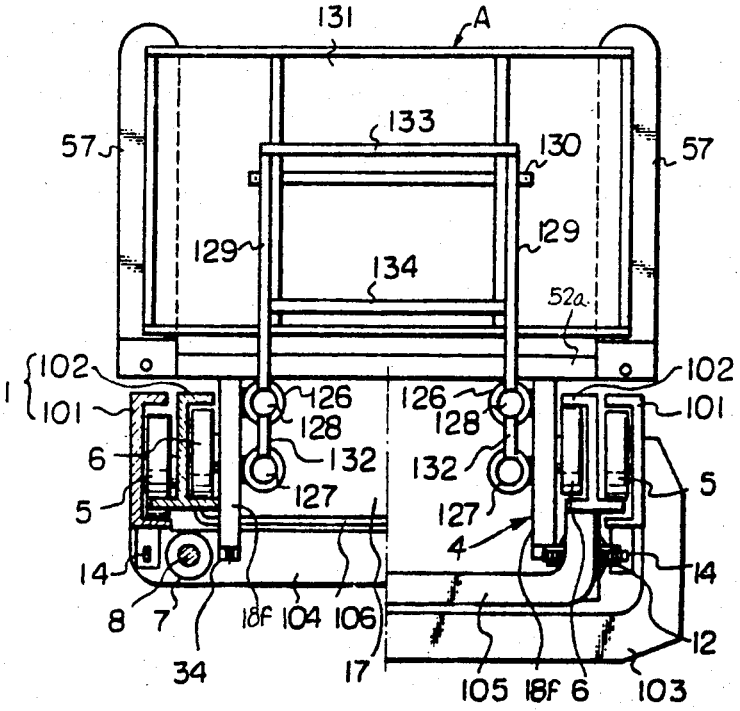

LOAD LIFTING UNIT FOR A LIFT TRUCK

This application is a continuation of application Ser. No. 660,944, filed Oct. 15, 1984, now abandoned, which, in turn, is a divisional application of application Ser. No. 424,100, filed Sept. 27, 1982, U.S. Pat. No. 4,505,635, which, in turn, is a continuation of application Ser. No. 189,838, filed Apr. 14, 1980, now abandoned.

TECHNICAL FIELD

This invention relates to a load lifting unit for a lift truck, and more particularly to a load-lifting unit for a counterbalance type lift truck in which a load center is located as near as possible to the body of the lift truck for the purpose of enhancing the stability of the lift truck as well as increasing the permissible load under conditions where various kinds of operating attachments are mounted on the load lifting unit.

BACKGROUND ART

Generally, in a load lifting unit of a lift truck, especially, of a counterbalance type lift truck, a lift cylinder for lifting and lowering a lift member including a fork carriage etc. and a support means such as lift roller etc. are arranged at a central portion between left and right uprights. Thus, the lift cylinder is positioned in front of the driver's seat, so that a wide region of the driver's forward view is obstructed.

Therefore, it is difficult to clearly see signs or obstructions or to watch the front end portion of a fork. This load lifting unit has various problems in safety and operating efficiency. In addition, since the lift cylinder is disposed at such a central portion between the uprights, an attachment such as a side shift fork, a hinged fork, a fork with a winch, a rotating clamp, or a reach fork must be mounted in such a way that the base portion of the attachment is fixed to the lift member so as not to interfere with the lift cylinder. To meet this requirement, the attachment is generally mounted on the fork carriage which is located at the forward position of the uprights. Therefore, the distance between the load center position of the attachment and the center of the front wheels is long. Moreover, since the attachment had its own actuating mechanism, the load center position is moved further forward away from the truck body. As a result, the permissible load of the lift truck is so reduced that a load lifting operation attainable by using a conventional fork cannot be effected, and it is possible to obtain only the loading capacity of a less powerful lift truck when the above-mentioned attachment is attached to the truck in place of the conventional fork. To overcome a significant reduction in the loading capacity, it has been proposed to reduce the thickness of the attachment, especially, of the actuating mechanism thereof, to recover the lost loading capacity. In the case of, for example, the rotating clamp or the rotating fork, it has been proposed to reduce the thickness of the rotator gear of a rotator while increasing the diameter thereof. However, if the thickness of the components of the attachment is reduced, the size of the component in a vertical plane should be increased to obtain the desired mechanical strength of the components. Therefore, the height of the attachment and the projected area of the attachment in the vertical plane are increased, and accordingly, the frontward view is further obstructed and the visible range for the forward operation from the driver's seat is greatly narrowed. In this connection, a countermeasure for improving the forward view from the driver's seat of the lift truck has been proposed. A specific example of the proposal was disclosed in Japanese Patent Publication No. Sho 49-29661. However, there has not yet been proposed a countermeasure which can attain both an improvement in the forward view and an increase in the permissible load while further attaining positive promotion of safety.

DISCLOSURE OF INVENTION

It is therefore an object of the present invention to provide an improved structure of a load lifting unit which is capable of improving the forward view from the driver's seat of a lift truck and yet capable of attaining an increase in the permissible load and an improvement in the stability of a counterbalance type lift truck. To achieve this object, the present invention proposes, first, to separately dispose lift cylinders, components of a load lifting unit, on the sides of left and right uprights, to form and secure a space between these uprights to widen the visible range of the forward view, and further adopts the following arrangement. More specifically, based on the fact that the permissible load can be increased as the distance between the center of the front wheels of the lift truck and the load center is reduced, it was first decided to remove or retract, from a position in front of the uprights, a fork carriage which is one of the components most influenced by a decrease or increase in such distance and which is an indispensable component of a lift member. Then, it was further decided to accommodate an actuating means for an attachment having a large service weight within the space created by such rearrangement. The actuating means, the lift member, etc. were thus rearranged to successfully reduce the aforesaid distance. Thus, the movement of the load center towards the truck body of the lift truck was successfully accomplished even when the lift truck was fitted with the attachment. As a result, not only can the forward view, especially, the visible range for the forward operation from the driver's seat of the lift truck, be improved but also the distance from the center of the front wheels of the lift truck to the load center can be reduced, so that the permissible load counterbalanced with the body weight of the lift truck can be increased and stability in the longitudinal direction of the lift truck can be promoted. The invention will be described in detail below, referring to embodiments illustrated in the accompanying drawings. In the embodiments illustrated in the drawings, same or like elements for attaining the same operation are denoted by the same reference numerals.

BRIEF DESCRIPTION OF DRAWINGS

FIG. 41 is a side elevational view of a lift truck equipped with a load lifting unit in accordance with still a further embodiment of the invention;

FIG. 42 is a half sectional plan view of an essential part of the same embodiment;

BEST MODE FOR CARRYING OUT INVENTION

Figure 1:
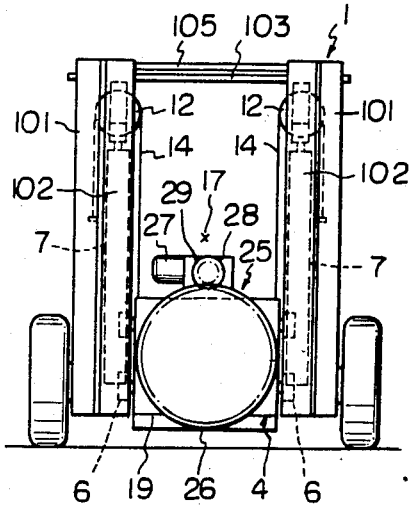
FIG. 1 is an elevational view of a first embodiment according to the present invention.
Figure 2:
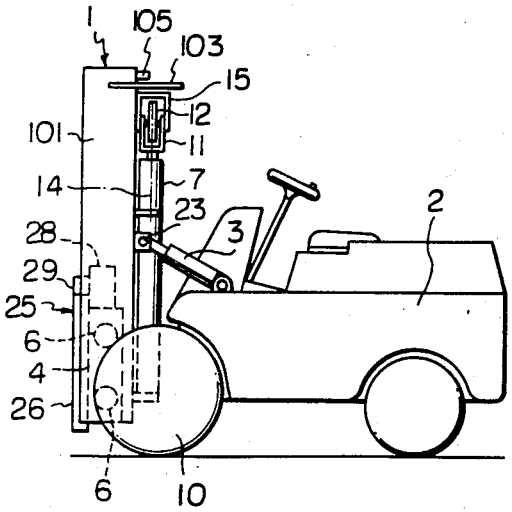
FIG. 2 is a side elevational view of the same embodiment.
Figure 3:
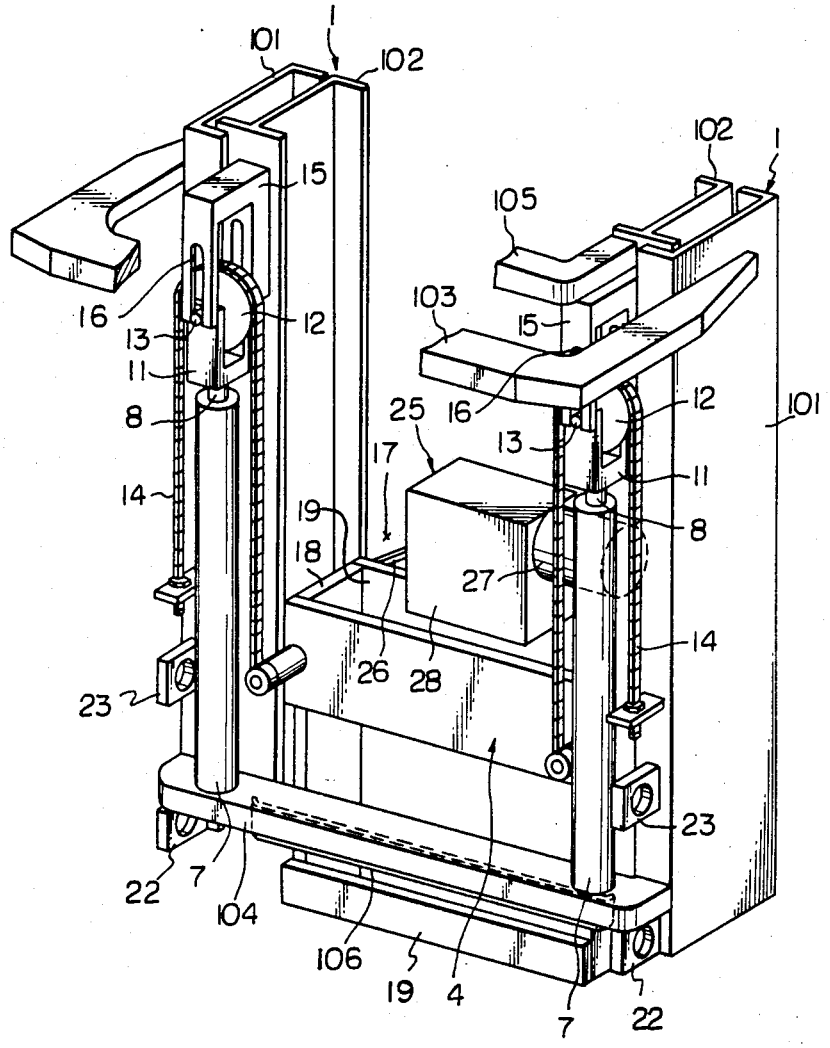
FIG. 3 is a perspective view of a main part of the same embodiment.
Figure 4:
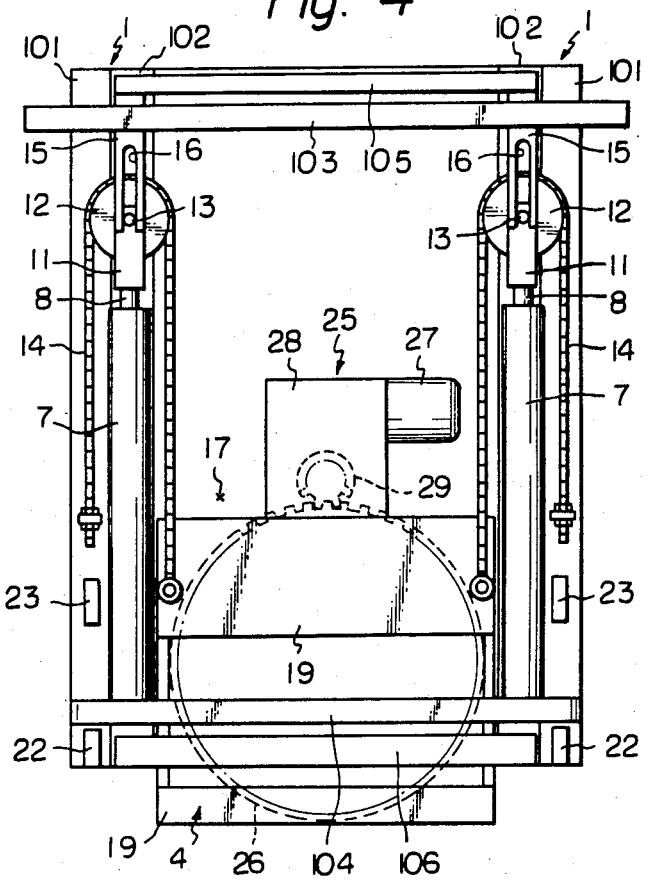
FIG. 4 is a front elevational view of the main part illustrated in FIG. 3.
Figure 5:
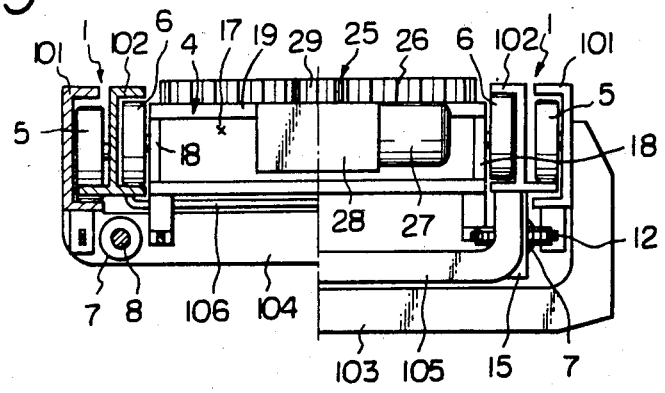
FIG. 5 is a partly sectional plan view of the same main part.

FIGS. 1 to 5 illustrate an embodiment wherein a rotating clamp is employed an an attachment for a load lifting unit of a lift truck. In the figures, 1 designates a pair of uprights each consisting of an outer mast 101 and an inner mast 102. The outer masts 101 are connected at the respective upper ends by an upper cross beam 103 and at the respective lower ends by a lower cross beam 104. The outer masts 101 are supported tiltably back and forth at their lower ends by a truck body 2 through a connecting bracket 22 and adapted to tilt back and forth through a pivotal connection between respective tilt cylinders 3 and brackets 23. On the other hand, the inner masts 102 are interconnected at their respective upper and lower ends by an upper tie beam 105 and a lower tie beam 106, respectively, and movable up and down relative to the respective outer masts 101 through respective lift rollers 5. Two lift cylinders 7 for lifting and lowering a lift member 4 comprised of side plate member 18 and cross plate members 19 are separately disposed on the sides of the left and the right uprights 1 especially rearward side positions of the respective uprights 1 (the lift cylinders 7 may be separately disposed outside the respective uprights 1) and stand on the lower cross beam 104 of the outer masts 101. A substantially U-shaped wheel support member 11 is fixed to an upper end of a piston rod 8 of each of the lift cylinders 7. Around a chain wheel 12 which is rotatably supported by the wheel support member 11 through a shaft 13, there is disposed a lift chain 14 fixed at one end thereof to the outer mast 101 and at the other end thereof to the lift member 4. A substantially U-shaped receiving member 15 fixed to the upper end portion of the respective inner mast 102 or the upper tie beam 105 is slidably fitted to the outside of the respective wheel support member 11. The receiving member 15 has, on the side walls thereof, elongated guide slots 16 extending vertically and engageable with the shaft 13 of the chain wheel 12. This arrangement gives the lift member 4 a free lift determined by the length of the guide slots 16. In this connection, it is to be noted that since a lift cylinder conventionally disposed between the left and the right uprights 1 is divided into two and disposed on the rear and side positions of the respective uprights 1, a large space 17 is formed between the left and the right uprights 1. The lift member 4 and an actuating mechanism 25 for a rotating clamp are arranged in the space 17. The lift member 4 is guided by the inner masts 102 through lift rollers 6 rotatably supported at the upper and lower portions of the respective side plate members 18, and is lifted and lowered by the lift cylinders 7. On the other hand, the actuating mechanism 25 of a rotating clamp comprises a rotator 26 toothed around the periphery thereof, an oil motor 27, a reduction gear 28 driven by the oil motor 27 and a pinion 29 for rotating the rotator 26 at a low speed reduced by the reduction gear 28. The rotator 26 is rotatably mounted on the front cross plate member 19 of the lift member 4, and the oil motor 27 and the reduction gear 28 are fixed to the upper end of the lift member 4. A pair of left and right clamp arms (not illustrated) are provided in front of the rotator 26.

As mentioned above, in accordance with an embodiment of the present invention, the two lift cylinders 7 are separately arranged at the rear of the respective uprights 1 so as to allow the lift member 4 and the actuating mechanism 25 of a rotating clamp to be disposed in the space 17 formed between the left and the right uprights 1. This enables the load center to be located nearer the truck body 2 as compared with the known arrangement in which the above-mentioned members are disposed in front of the upright, thereby improving the loading capacity of a lift truck. Furthermore, since the actuating mechanism 25 of a rotating clamp can be disposed nearer the truck body 2, i.e., since the distance from the center of front wheels 10 to the front of the rotator 26 can be reduced, the visible region for forward operation from the driver's seat is enlarged. This contributes to an improved forward view because the disadvantages involved in the known arrangement wherein attachment components are formed thin but large in diameter to obtain a necessary loading capacity are eliminated. In addition, an arrangement of the two lift cylinders 7 at the rear side positions of the respective uprights 1 also contributes to an improved forward view from the driver's seat. Furthermore, since the lift cylinders 7 are arranged on the left and the right side, respectively, a stable load handling operation can be assured even if an unbalanced load is applied to the rotating clamp.

Figure 6:
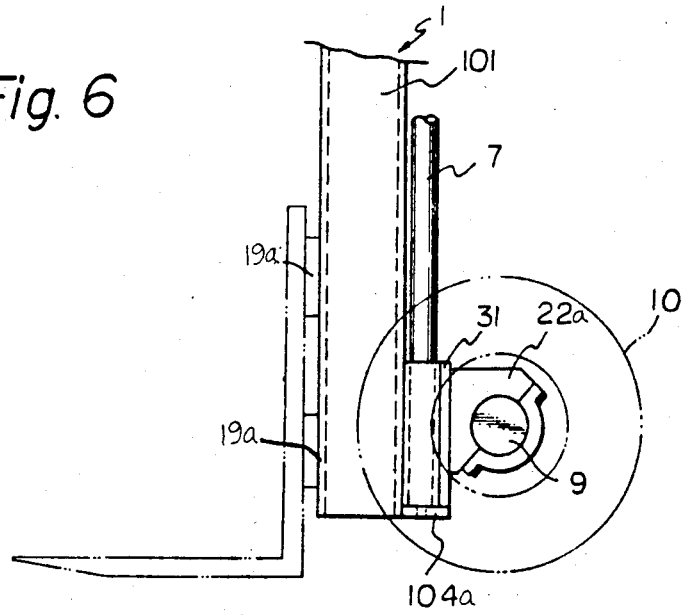
FIG. 6 is a schematic side view of an essential part of a modification of the embodiment illustrated in FIGS. 1 through 5.
Figure 7:
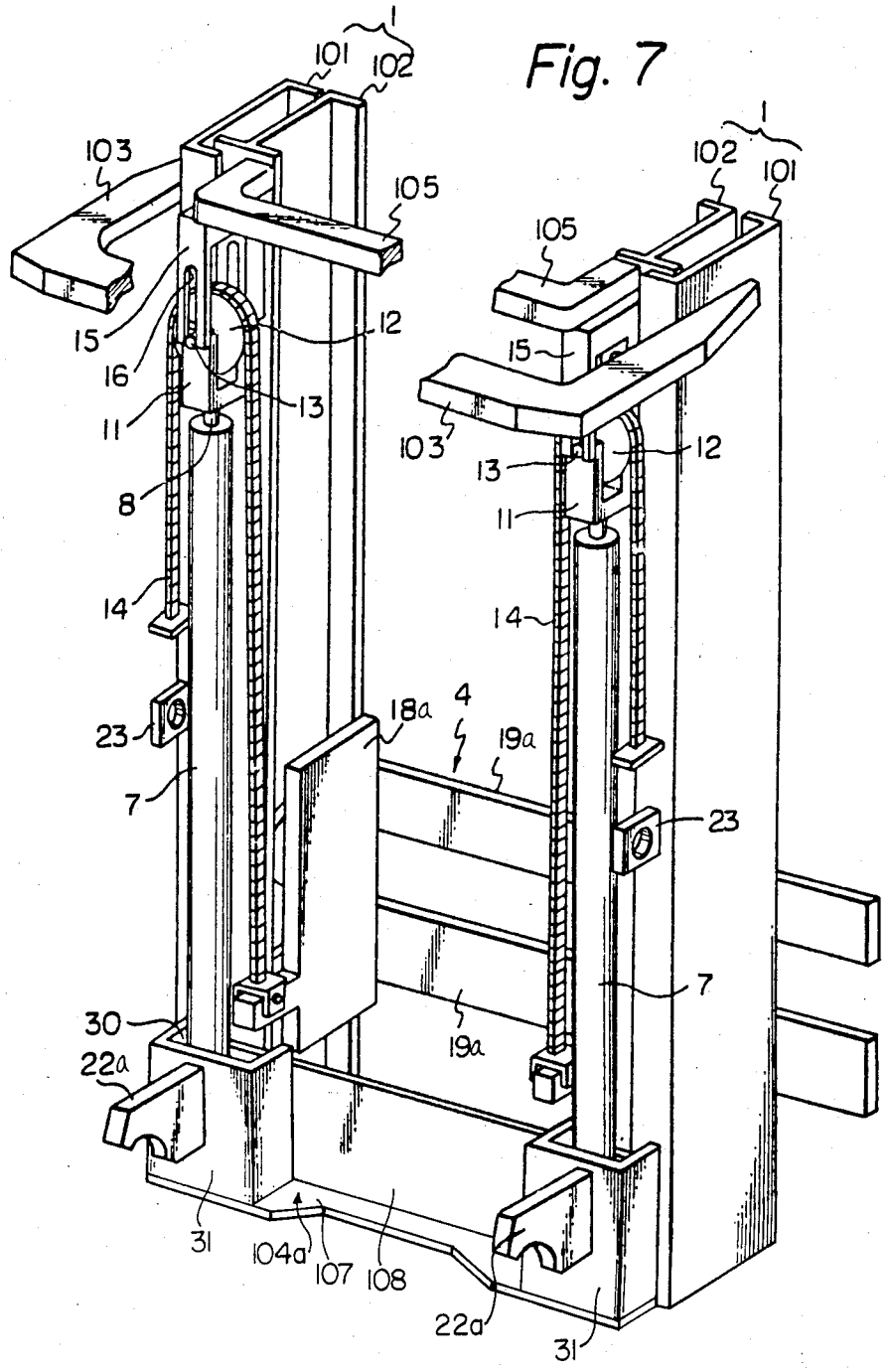
FIG. 7 is a perspective view of the essential part of the same modification.
Figure 8:
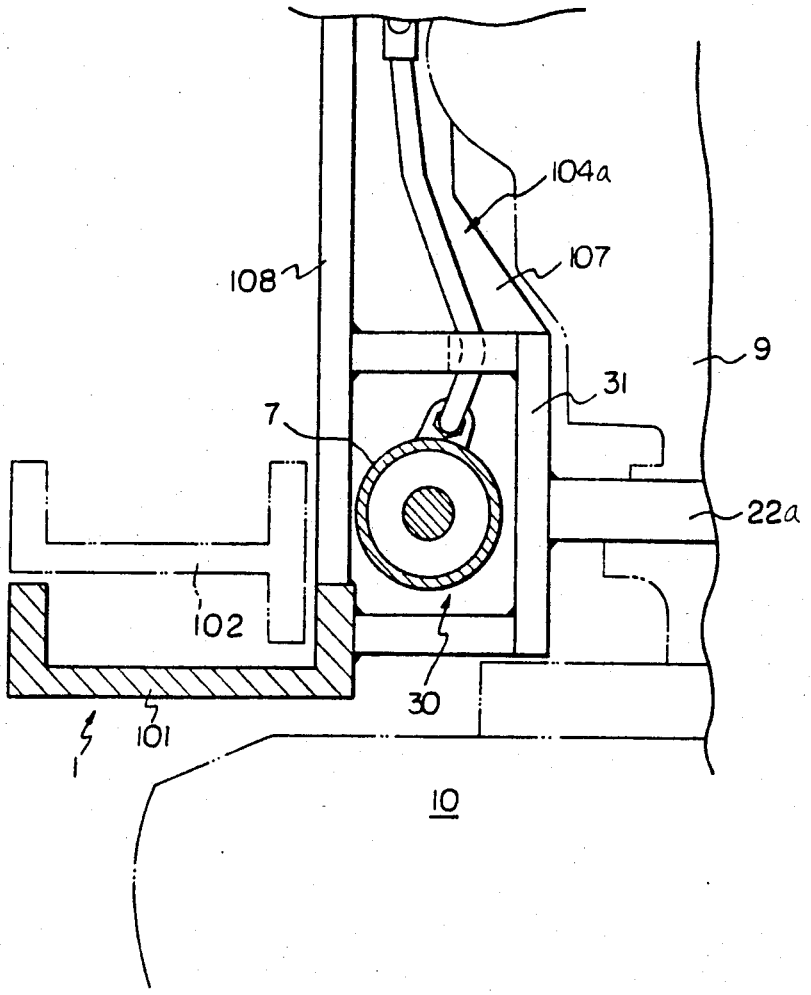
FIG. 8 is a partially sectional plan view of the same modification.

More specifically, in the load lifting unit for a lift truck according to the present invention, there can be obtained various effects such that the loading capacity is increased by an increase in the permissible load of the load lifting unit when an attachment is mounted on the unit, the stability of the entire vehicle is increased and the frontward view from the driver's seat is improved. If the two lift cylinders 7 are separately disposed on the sides of the respective uprights 1, especially on the rear and side positions of the uprights 1, there may be employed a structure of a load lifting unit according to a modified embodiment as illustrated in FIGS. 6 through 8. In the embodiment illustrated in FIGS. 6 through 8, the upright forming portion of the load lifting unit has substantially the same structure as the embodiment of FIGS. 1 through 5. In the figures, two lift cylinders 7 for lifting and lowering inner masts 102 and a lift member 4, which is adapted to slide for lifting and lowering along the inner masts 102 and comprised of side plate members **18*a* and cross plate members 19*a*, are disposed at the rear of respective uprights 1 preferably within a region which is located behind the uprights 1 so as not to obstruct further the driver's forward view. The lower ends of the respective cylinders 7 are mounted on the lower cross beam 104*a* provided at the lower ends of the respective outer masts 101 at positions within spaces 30 defined by rear flanges of the uprights 1, a front axle 9 and front wheels 10. The periphery of the lower end portion of each of the lift cylinders 7 is encompassed by a bracket 31 formed in a box-shape and welded to a planar portion 107, a rising portion 108 of the lower cross beam 104*a* and the rear flange portion of the outer mast 101**.

On the other hand, a substantially U-shaped wheel support member 11 is fixed to the upper end of a piston rod 8 provided on each of the lift cylinders 7. A lift chain 14, fixed at one end thereof to the outer mast 101 and at another end thereof to the lift member 4, is set around a chain wheel 12 rotatably supported by the wheel support member 11 through a shaft 13. Identical to the foregoing embodiment, a substantially U-shaped receiving member 15 fixed to upper end portions of the respective inner masts 102 or to an upper tie beam 105, is slidably fitted to the wheel support member 11. The receiving member 15 has elongated guide slots 16 formed on side walls of the member 15 which are engageable with the shaft 13 of the chain wheel 12. Thus, a free lift determined by the length of the guide slots 16 is given to the lift member 4. Alternatively, there may be employed a structure wherein an elongated guide bar fixed at an end thereof to the upper tie beam 105 is employed in place of the U-shaped receiving member 15 and a vertically extending slot is formed on the wheel support member 11 at a position thereof aligned with the bar so that the slot may slidably receive the bar therein to provide a free lift to the lift member. Connecting brackets **22*a* for connecting the body of the lift truck and the upright forming portion are rotatably mounted on the front axle 9 and fixed at the respective forward ends to the brackets 31 (or the rear flange portions of the outer masts 101). The uprights 1 are tiltable forwardly and backwardly, relative to the axis of the front axle 9, upon actuation of tilt cylinders (identical to the tilt cylinders 3 illustrated in FIG. 2). As is apparent from the foregoing description, since the two lift cylinders are separately arranged on the rear and side positions of the respective uprights 1, load lifting unit components, which otherwise would obstruct the view immediately forward of the driver's seat of the truck can be re-arranged to improve the forward view. As a result, inspection of the load condition on the attachment (an ordinary fork in FIG. 6**) can be highly facilitated, and signs or obstructions can be observed at a glance during the operation of the lift truck. Also, because of the improvement in the operating efficiency and stability, the operator's fatigue is reduced.

Since the lift cylinders 7 are symmetrically disposed at the rear of the respective uprights 1, and since the lower ends thereof are located on the same level as the lower ends of the uprights 1, the center of gravity of the entire load lifting unit is moved towards the front axle 9, enhancing the stability of the entire vehicle, and the piston stroke of each of the piston rods 8 may be suitably determined according to the length of each of the inner masts 102 to obtain a length of the upright sufficient for effecting a required lifting and lowering operation of the attachment and to allow the amount of a free lift to be selected as desired.

Figure 9:
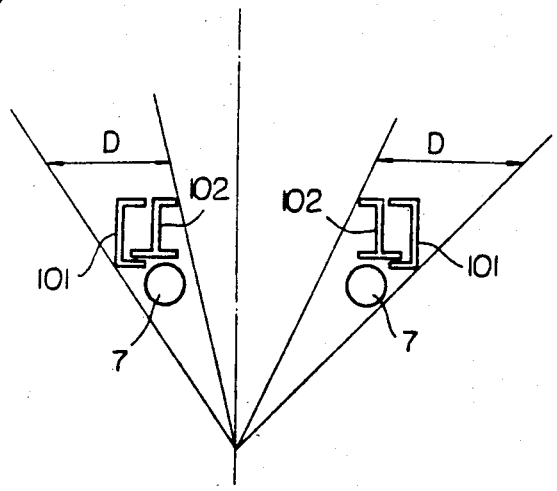
FIG. 9 is a diagrammatic explanatory view illustrating a region in which the forward view is obstructed.

Furthermore, when the two lift cylinders 7 are separately disposed at positions to the rear and side of the respective uprights 1, they may advantageously be disposed behind a range D which is always produced in front of the respective inner masts 102 by the inner masts 102 as illustrated in FIG. 9, so that the diameter of each of the lift cylinders 7 may be freely selected if the lift cylinders 7 can be disposed behind ranges D. Accordingly, if lift cylinders 7 having a diameter as large as possible are employed, the load lifting capacity is greatly increased. In addition, since the lift cylinders 7 can be disposed not only near the respective inner masts 102 but also near the lift member 4 engaged with and slidable relative to the masts, and since in the chain wheels 12 provided at the top ends of the respective piston rods extending from the lift cylinder 7 each chain wheel has a laterally inner end on the periphery thereof confronting the lift member 4 and located substantially above and close to the connecting point of the lift member 4 and the chain, it is ensured that a load can be applied to the center of the respective piston rods. Accordingly, the occurrence of unbalanced loads is reduced, an effective lifting force is exerted and packings fitted to the cylinders and the pistons can be protected. Moreover, since the periphery of the lift cylinder is not projected outwardly from the outer face of the outer mast, the inner face of the front wheel can be located very close to the outer face of the outer mast. Therefore, there is no need to increase the width of the truck and also there is no danger that the cylinders will collide with obstacles.

Figure 10:
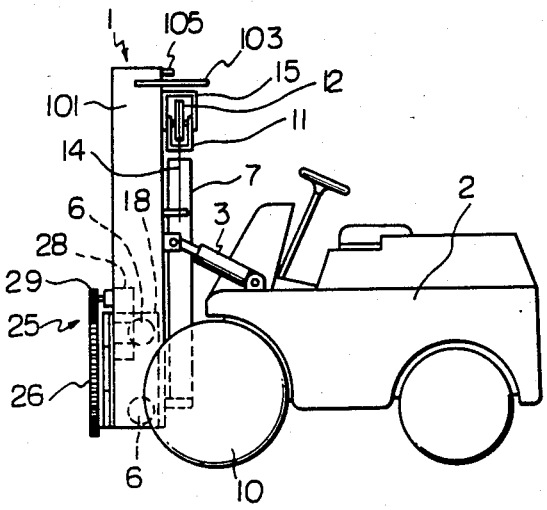
FIG. 10 is a side elevational view of a lift truck equipped with a load lifting unit in accordance with another embodiment of the invention.
Figure 11:
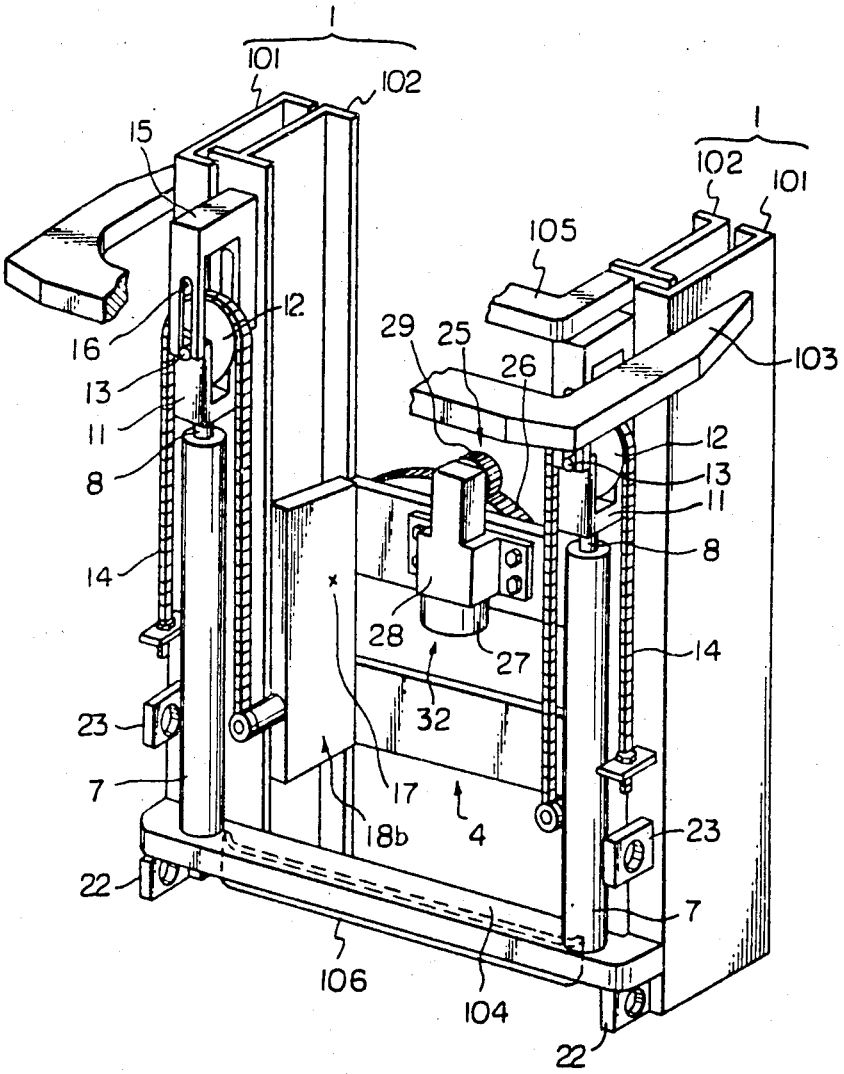
FIG. 11 is a partially cutaway perspective view of an essential part of the same embodiment.
Figure 12:
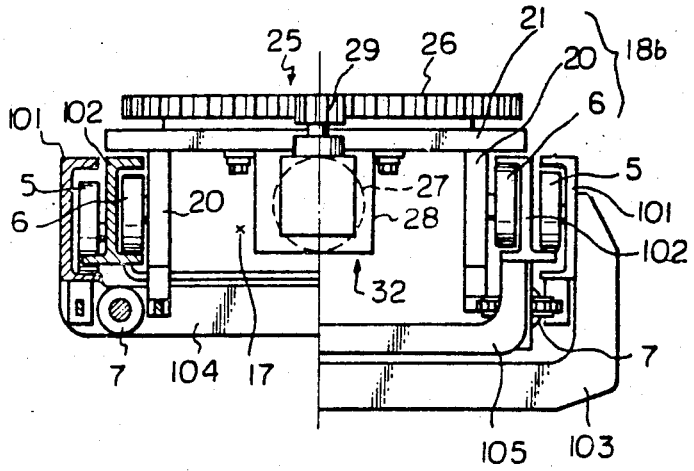
FIG. 12 is a partial sectional plan view of the essential part of the same embodiment.

As a modified embodiment of the first embodiment as mentioned before and illustrated in FIGS. 1 through 5, a further embodiment wherein a rotating actuating mechanism for a rotating type attachment is arranged at a rear portion of a finger bar of a lift member, will be described below with reference to FIGS. 10 through 12. In the embodiment illustrated in FIGS. 10 through 12, a left and a right upright 1, lift cylinders 7, etc., are constructed and arranged in the same manner as in the aforesaid first embodiment. Accordingly, the particulars thereof will not be repeated here and only characteristic structures and operational effects particular to the present embodiment will be described.

In a space 17 formed between a left and a right upright 1 due to the separate arrangement of two lift cylinders 7 at the rear of the respective uprights 1, there is arranged a side plate member **18*b* comprised of a pair of left and right side plates 20 each having lift rollers 6 rotatably supported at upper and lower portions thereof, respectively, and a cross plate 21 crossingly fixed to the front portions of the side plates 20. The side plate member 18 is adapted to be lifted and lowered by the lift cylinders 7 while being guided by inner masts 102 through the lift rollers 6. On the front face of the front cross plate 21 of the side plate member 18, there is provided a rotation actuating mechanism 25 for an operating attachment (not illustrated) such as a rotating fork or a rotating clamp. The rotation actuating mechanism 25 will now be described more specifically. As illustrated in FIG. 12, the rotation actuating mechanism 25 is mainly comprised of a rotator 26, an oil motor 27, a reduction gear 28 (including a change mechanism for a driving shaft position) driven by the oil motor 27, and a pinion 29 fitted to the shaft end of the reduction gear 28 and adapted to rotate the rotator 26 at a reduced low speed. The rotator 26 is attached to the front face of the front cross plate 21 of the side plate member 18**.

A driving portion 32 comprised of the oil motor 27 and the reduction gear 28 which are disposed horizontally above the rotator 26 in the conventional arrangement is provided on the back face of the front cross plate 21 within the space 17. More specifically, as illustrated in FIG. 11, the reduction gear 28 connected directly to the oil motor 27 at the back thereof is arranged vertically and fixed to the back face of the front cross plate 21 by means by screw bolts.

Figure 13:
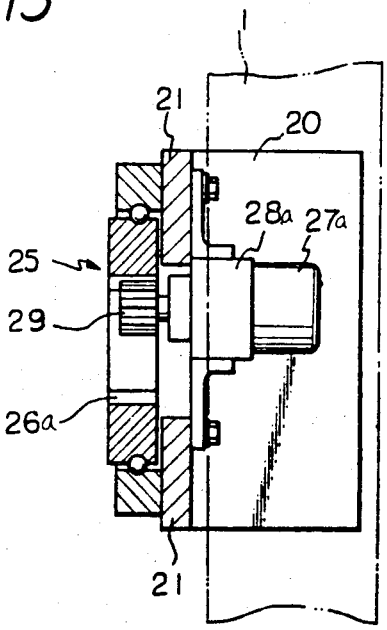
FIG. 13 is a partial sectional side elevational view of a modification of the embodiment illustrated in FIGS. 10 through 12.
Figure 14:
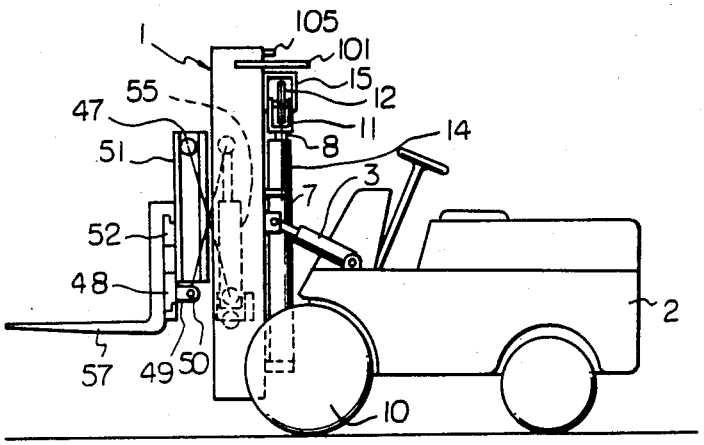
FIG. 14 is a side elevational view of a lift truck equipped with a load lifting unit in accordance with still another embodiment of the present invention.
Figure 15:
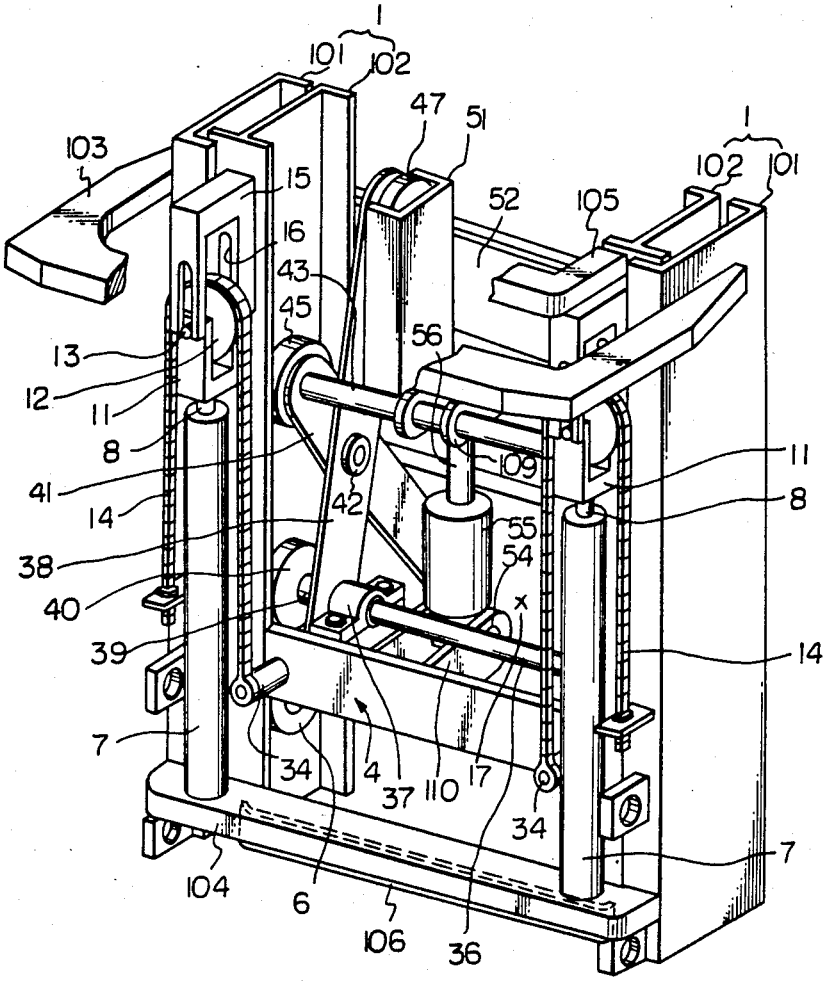
FIG. 15 is a partially cutaway perspective view of a main part of the same embodiment.
Figure 16:
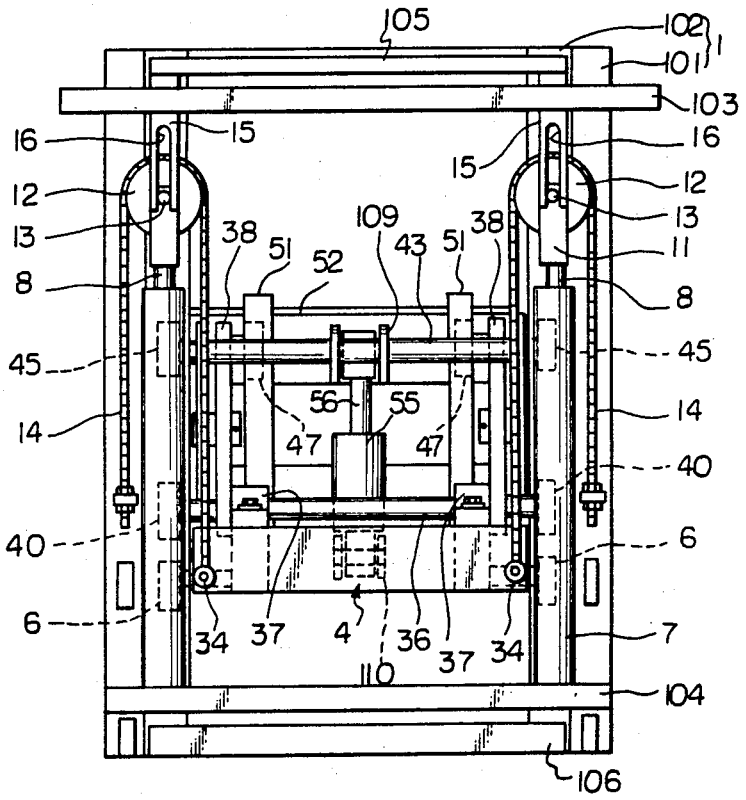
FIG. 16 is a front elevational view of the main part of the same embodiment.
Figure 17:
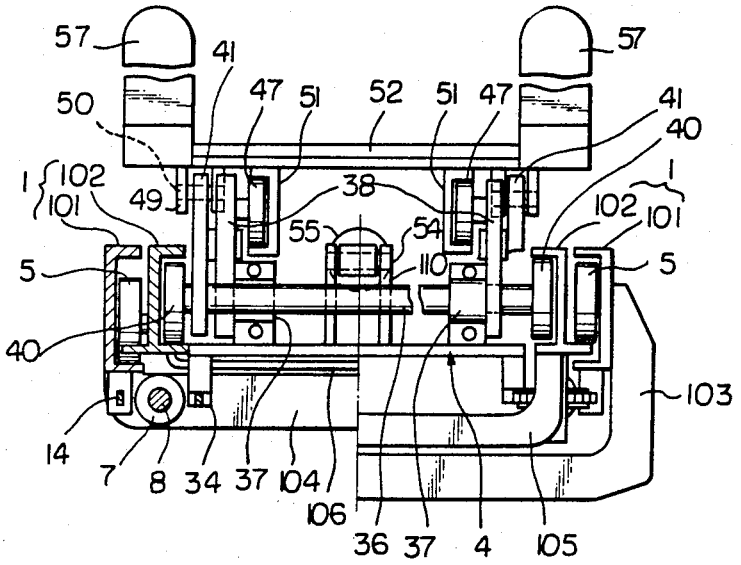
FIG. 17 is a partial sectional plan view of the same embodiment.
Figure 18:
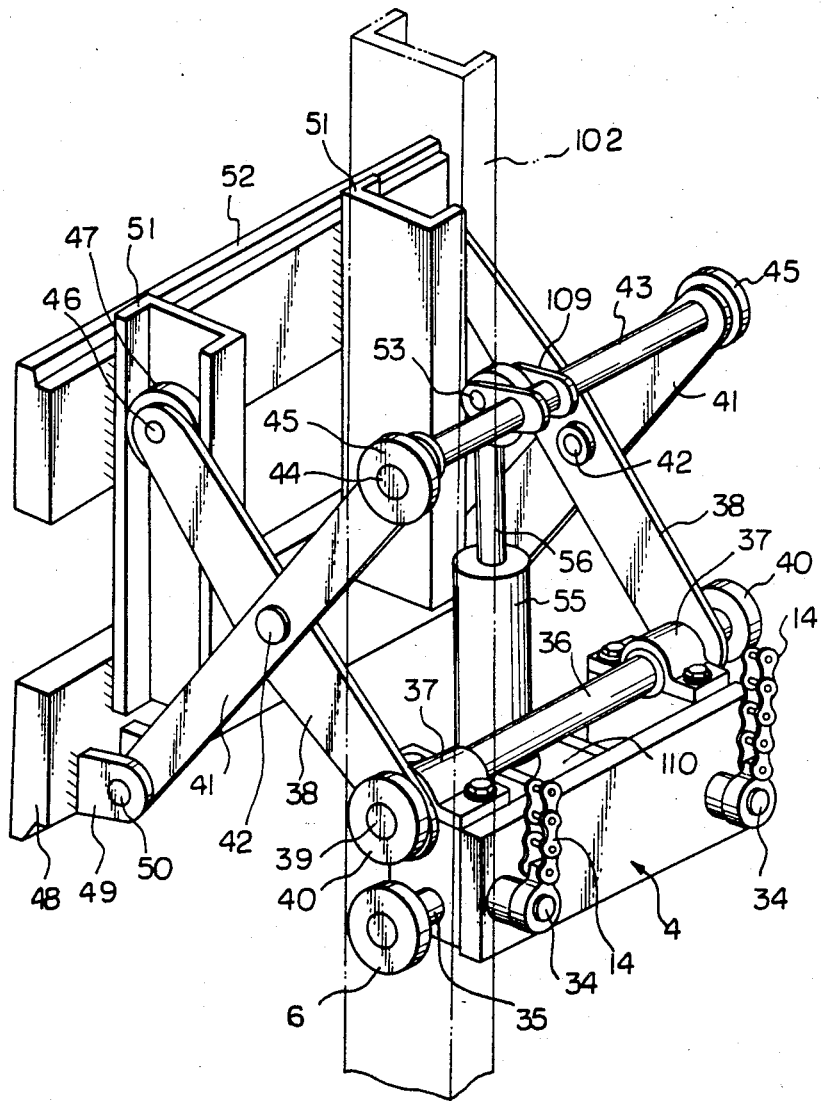
FIG. 18 is a perspective view of the main part of the same embodiment.
Figure 19:
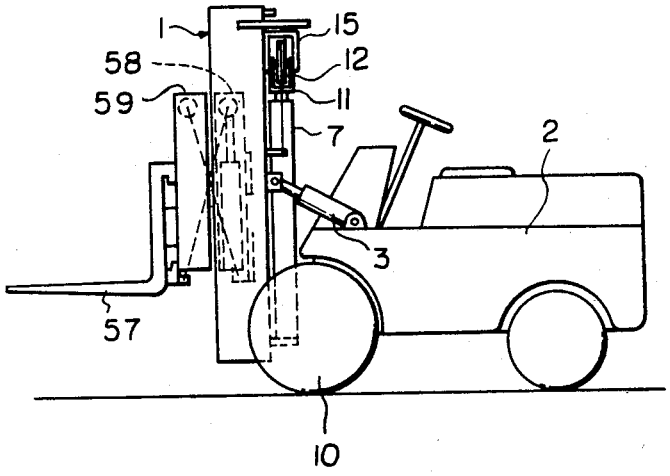
FIG. 19 is a side elevational view of a lift truck equipped with a load lifting unit in accordance with a further embodiment of the present invention.
Figure 20:
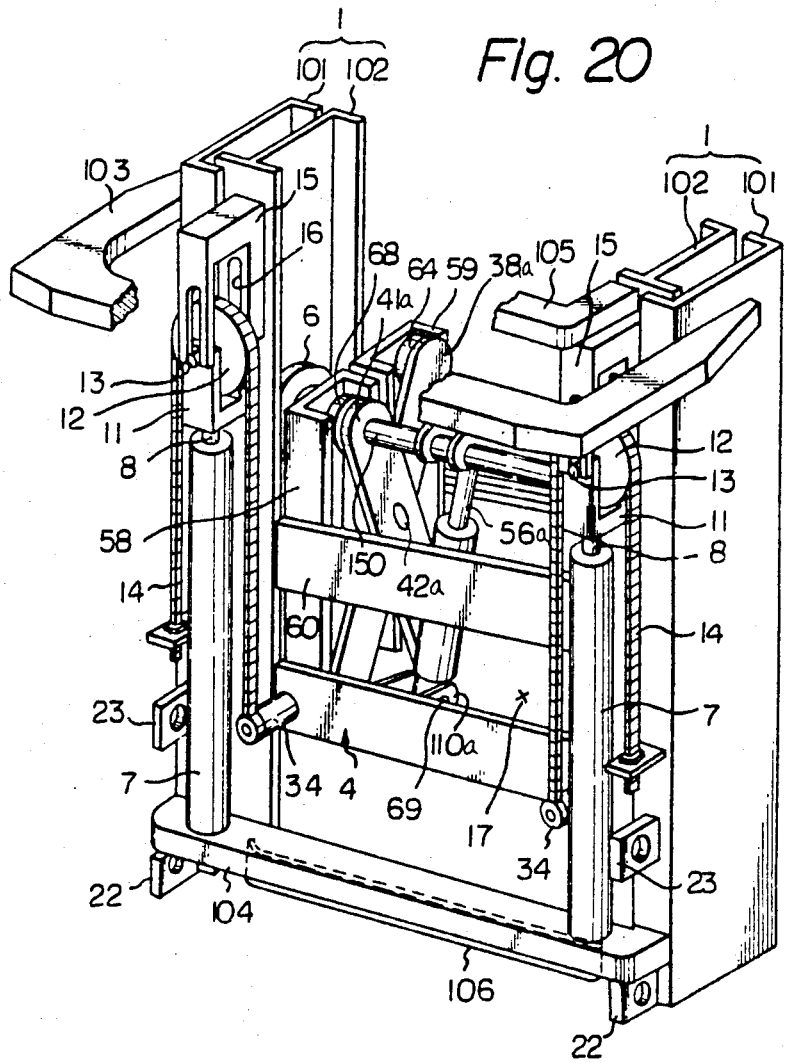
FIG. 20 is a partially cutaway perspective view of a main part of the same embodiment.
Figure 21:
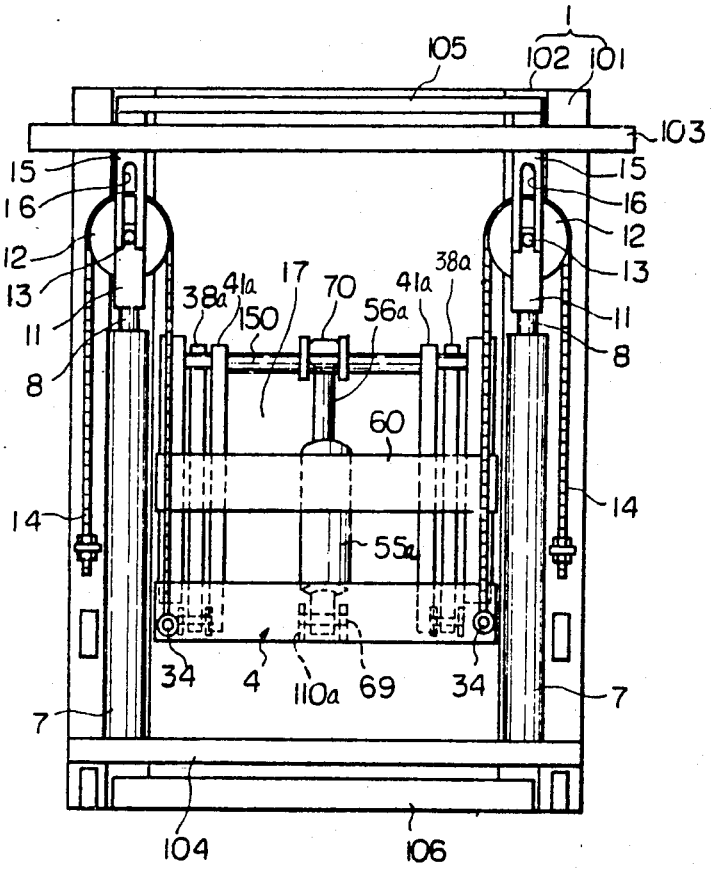
FIG. 21 is a front elevational view of the main part of the same embodiment.

If the rotator **26*a* has an internally-toothed gear, the reduction gear 28*a* with the oil motor 27*a* having the pinion 29 fitted to the shaft end thereof may be fixed to the back face of the front cross plate 21 by means of screw bolts in the same manner as mentioned above. This modification is illustrated in partial sectional plan view in FIG. 13**. As is apparent from the foregoing description, by arranging a drive means such as the oil motor and the reduction gear of the rotation actuating mechanism at the rear of the front cross plate of the lift member, the drive means is accommodated in the space between the left and the right upright. As a result, the front view from the driver's seat of a lift truck is improved and the drive means, such as the oil motor and the reduction gear, is advantageously protected by the cross plate, the uprights, etc., so as not to be hit directly by cargo and subjected to damage if the cargo accidentally falls.

A lift truck to which a reach type fork device is attached on the load lifting unit in accordance with a further embodiment of the present invention will be described below, referring to FIGS. 14 through 18.

In general, the reach type fork device is very thick and heavy and when set on the load lifting unit, the load center position is moved forwardly from the lift truck body. Therefore, not only is the permissible load of the lift truck apt to be greatly reduced but also the longitudinal stability of the truck per se is apt to be adversely affected, whereby considerable degradation of the truck's performance is caused. The present invention improves such a tendency.

In FIGS. 14 through 18, a pair of left and right uprights 1 each consisting of an outer mast 101 and an inner mast 102 are so formed that the outer masts 101 are connected to one another at their respective upper ends by an upper cross beam 103 and at the lower ends by a lower cross beam 104, supported, at their respective lower ends, tiltably forward and backward by a front end of a truck body 2 and adapted to be tilted forwardly and backwardly by tilt cylinders 3, while the inner masts 102 are connected at their respective upper ends and at their respective lower ends by an upper tie beam 105 and a lower tie beam 106, respectively, and movable up and down relative to the respective outer masts 101 through respective lift rollers 5 in the same manner as in the foregoing embodiments. Two lift cylinders 7 for lifting and lowering a lift member 4 are disposed at positions at the rear of the respective uprights 1 (they may alternatively be disposed at positions outside of the respective uprights 1) and are positioned so as to stand on the lower cross beam 104 of the outer masts 101. A substantially U-shaped wheel support member 11 is fixed to an upper end of a piston rod 8 of each of the lift cylinders 7. The wheel support member 11 rotatably supports thereon a chain wheel 12 through a shaft 13. A lift chain 14 fixed at one end thereof to the outer mast 101 and connected at the other end thereof to a chain anchoring pin 34 projected from the rear face of the lift mamber 4 is arranged around the chain wheel 12. A substantially U-shaped receiving member 15 which is fixed to the upper end of the inner mast 102 or the upper tie beam 105 is slidably fitted to the outside of the wheel support member 11. The receiving member 15 has vertically extending guide slots 16 formed on respective side walls thereof. This provides the lift member 4 with a free lift determined by the length of the guide slots 16. The arrangement wherein the two lift cylinders 7 are disposed at positions at the rear of the respective uprights 1 provides a considerably large space between the left and the right upright 1. A reach type fork device as will be mentioned later is disposed within the space.

A reach fork device set on the lift member 4 will be described in detail below.

In FIGS. 14 through 18, numeral 6 designates lift rollers rotatably mounted on opposite sides of the lift member 4 at the lower portions thereof through pins 35. Numeral 36 designates a first connecting shaft supported above the lift member 4 by bearings 37, and 38 designates first link members constituting a pantograph type reach mechanism which are rotatably connected at respective rear inner portions thereof to the ends of the first connecting shaft 36, respectively, and rotatably supports, on respective outer ends thereof, rolling rollers 40. Numeral 41 designates second link members constituting the reach mechanism each of which is connected at a middle portion thereof to a middle portion of the corresponding first link member 38 by a pin 42 so as to rotate relative to each other, and further, each of the second link members 41 is rotatably connected at a rear inner portion thereof to a second connecting shaft 43 and rotatably supports on a rear outer end thereof a rolling roller 45 through a pin 44.

On the other hand, rolling rollers 47 are rotatably supported by the first link members 38 at forward and inner portions thereof through pins 46, respectively. The forward ends of the respective second link members 41 are rotatably connected to brackets 49, respectively, which are fixed to the back face of a lower finger bar 48 through pins 50. Numeral 51 designates reach rails fixed at forward ends thereof to the back face of an upper fork carriage 52 and the back face of a lower fork carriage 48 and receive in the inside thereof the rolling rollers 47, respectively, which are rotatably supported at respective forward ends of the first link members 38. Numeral 109 and 110 are brackets fixed to central portions of the second connecting shaft 43 and the lift member 4, respectively. A reach cylinder 55 is rotatably connected, at a piston rod portion thereof, to the bracket 109 through a pin 53 and rotatably connected, at a base portion thereof, to the bracket 110 by a pin 54.

Numeral 57 is a fork mounted on the upper and the lower fork carriages 52 and 48. The rolling rollers 40 and 45 and the lift roller 6 are received in the inner rail 102. Therefore, upon actuation of the lift cylinders 7, the lift member 4, the first and the second link members 38 and 41, the reach rails 51 and the upper and the lower fork carriages 52 and 48 are lifted and lowered conjointly. When the reach cylinder 55 is actuated, the rolling rollers 45 are moved towards or away from the respective rolling rollers 40 within the respective inner masts 102 so that the reach rails 51 and the upper and the lower fork carriages 52 and 48 are moved forwardly away from the truck body or moved towards the truck body. Thus, the fork 53 effects reaching and retracting motions in front of the lift truck.

As is apparent from the arrangement as mentioned above, since the lift cylinders 7 are separately disposed at the side portions, especially, at the rear and side positions of the respective uprights respectively consisting of the inner mast 102 and the outer mast 101, so that the lift member 4 of the load lifting unit is disposed within the space 17 formed between the left and the right uprights, and furthermore, since the entire attachment assembly comprising the reach type fork can be moved close to the truck body 2 when mounted, the center of gravity of the reach type fork device is located near the truck body. As a result, the position of the center of a load is moved closer to the truck body 2 as compared with a conventional arrangement wherein a fork carriage and an attachment are located in front of the uprights. Consequently, a reduction in the permissible load caused by the attachment device can be effectively avoided and the loading capacity of the fork lift truck and stability of the truck are enhanced.

In addition, since the distance from the center of the front tires to the forward end of the reach rail 51 can be reduced, the frontword view from the driver's seat can be improved as compared with the known structure. Furthermore, since the lift cylinders 7 are symmetrically arranged, stability against an unbalanced load can be enhanced.

Although the first connecting shaft 36 is supported by the lift member 4 through the bearings 37 in the present embodiment, there may alternatively be employed such an arrangement that short shafts are fixed to the sides of the lift member 4 and the first link members 38 are rotatably connected at the respective rear ends thereof to the short shafts, respectively. The present invention may also be applied to a pusher device equipped with a reach mechanism rather than the reach type fork devices illustrated in the present embodiment.

FIGS. 19 through 22 illustrate another embodiment wherein a reach type fork device is attached as an attachment to load lifting unit as in the foregoing embodiment. Therefore, explanation of structures similar to those in the embodiment illustrated in FIGS. 14 through 18 are omitted here and only the characteristic structure and operational effect particular to the present embodiment will be described.

In FIGS. 19 through 22, a lift member 4 forming a part of the load lifting unit is fixed to the rear faces of a pair of left and right rear rails 58 at the lower portions thereof. A connecting beam 60 is connected to the middle portions of the rear faces of the pair of the rear rails 58. The rear rails 58 are adapted to be lifted and lowered together with the lift member 4 by respective lift cylinders 7 while being guided by respective inner masts 102 through lift rollers 6 rotatably supported at upper and lower portions of the outer side faces of the respective rear rails 58.

A pair of left and right front rails 59 having the shape of a channel member, respectively are provided in front of respective rear rails 58. The front rails 59 are movable in the forward and backward direction along a fore-and-aft axis of a lift truck relative to the respective rear rails 58 by a reach mechanism. More specifically, inside of a left and a right upright 1 there are disposed pairs of links **38*a* and 41*a*, each pair of links being combined and rotatably connected to each other at their respective central portions by a connecting pin 42*a***.

Figure 22:
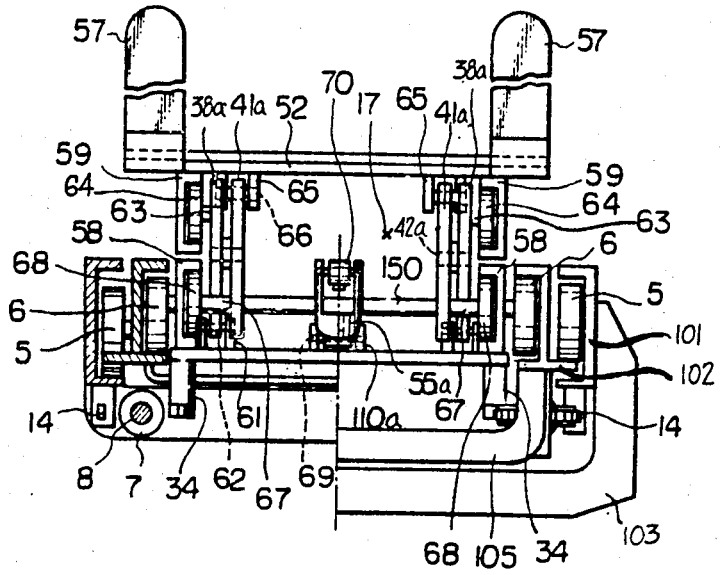
FIG. 22 is a partial sectional plan view of the same main part.
Figure 23:
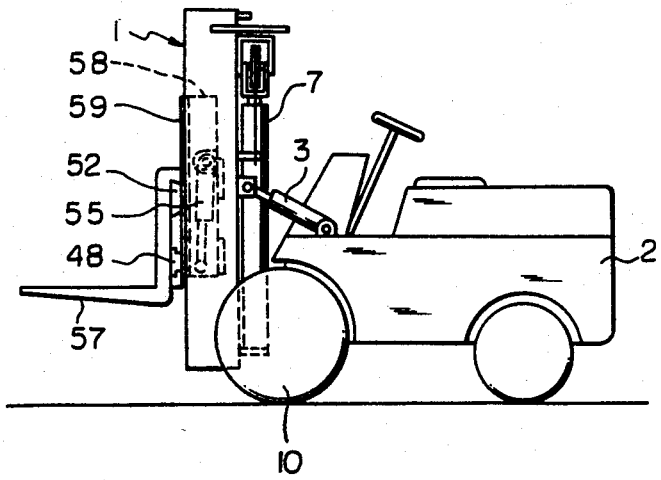
FIG. 23 is a side elevational view of a lift truck equipped with a load lifting unit in accordance with a further embodiment of the present invention.
Figure 24:
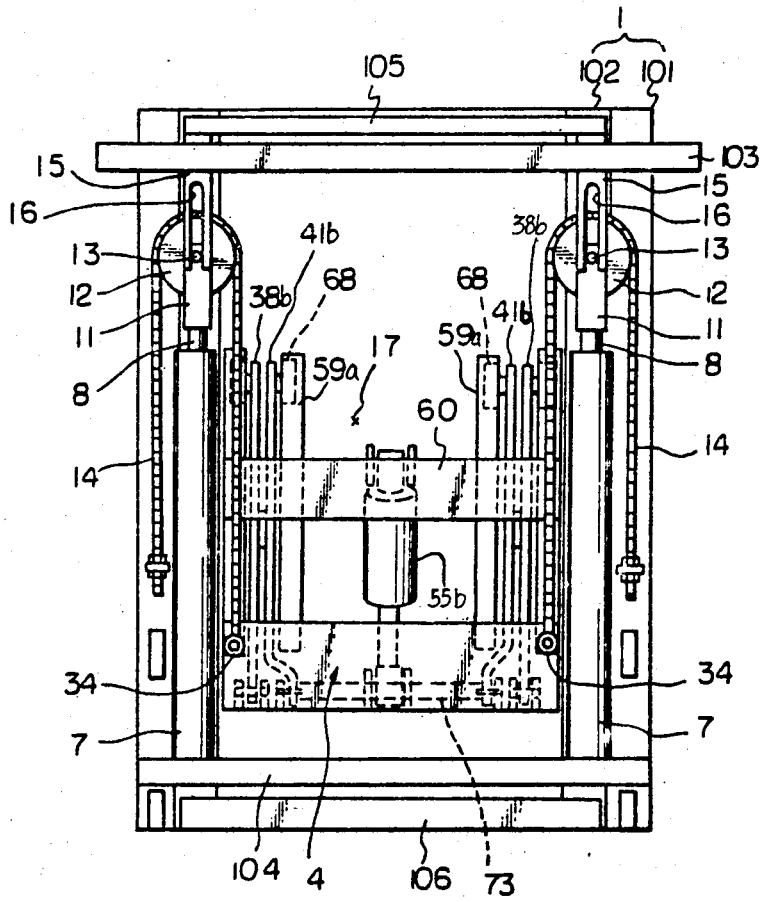
FIG. 24 is an elevational front view of a main part of the same embodiment.
Figure 25:
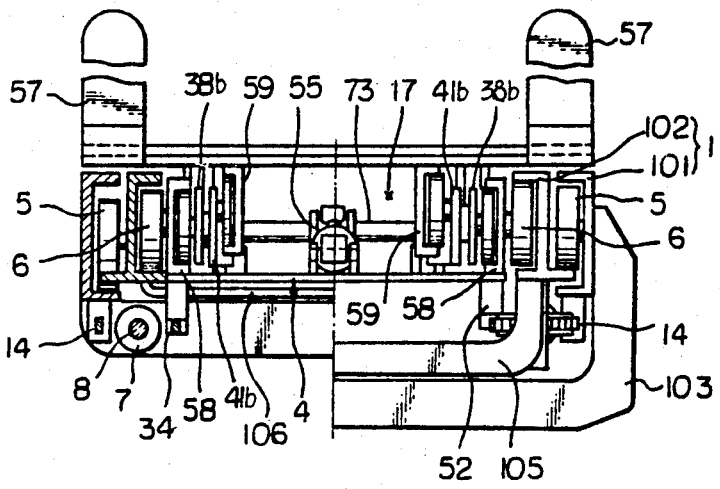
FIG. 25 is a partial sectional plan view of the main part of the same embodiment.
Figure 26:
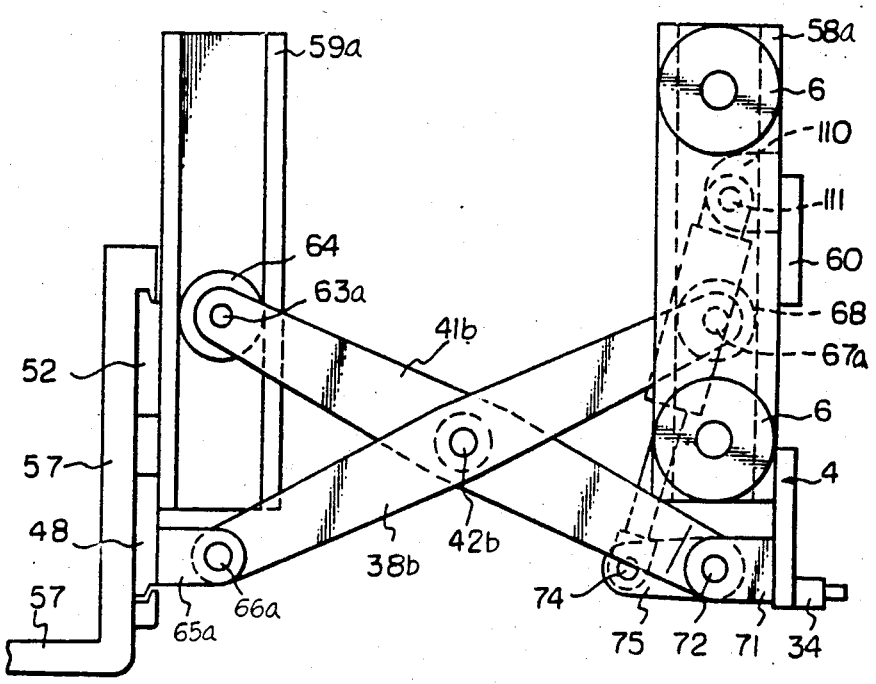
FIG. 26 is a side elevational view of a portion of the same embodiment.
Figure 27:
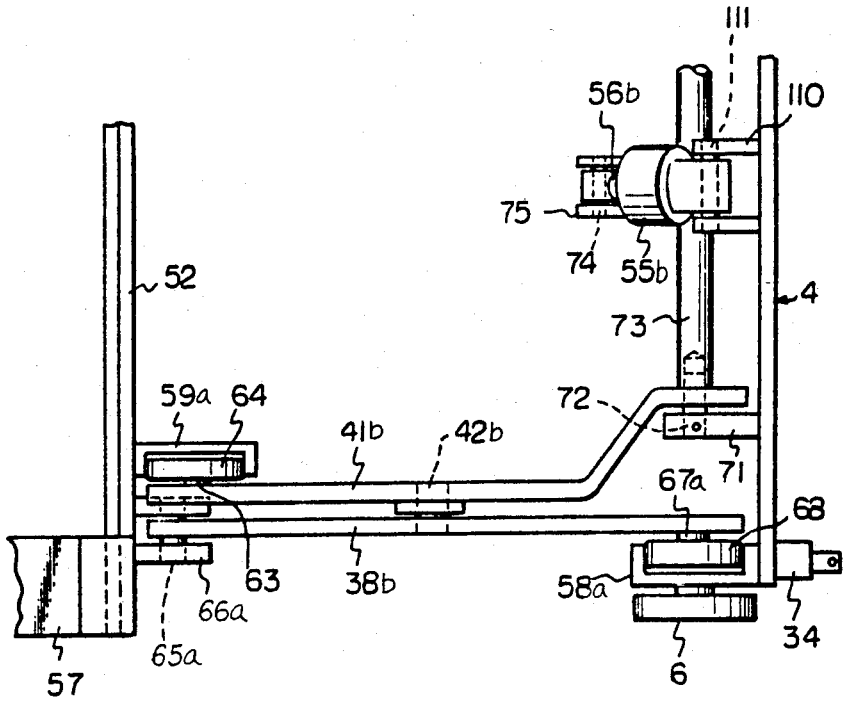
FIG. 27 is a fragmentary plan view of the portion illustrated in FIG. 26.

The pairs of the links **38*a* and 41*a* constitute the reach mechanism. The links 38*a* located outside of the links 41*a* are rotatably connected, at their respective lower ends, to corresponding support members 61 projected from the front face of the lift member 4 by pins 62 and have at their respective upper ends rolling rollers 64 rotatably mounted by support shafts 63 respectively. The rolling rollers 64 are received in the corresponding front rails 59**, respectively. On the other hand, the links 41*a* located inside of the links 38*a* are rotatably connected, at their respective lower ends, to support members 65 projected from the rear face of a fork carriage 52 for connecting the front portions of the front rails 59, respectively, and have rolling rollers 68 rotatably mounted by shafts 67, respectively. The rolling rollers 68 are received in the corresponding rear rails 58, respectively. The upper ends of the respective links 41*a* are connected by a connecting shaft 150 and the central portion of the connecting shaft 150 in the reach mechanism is connected through a joint 70 to a tip end of a piston rod 56*a* of a reach cylinder 55*a* mounted on the front face of the lift member 4 by a bracket 110*a* and a pin 69. Therefore, upon actuation of the reach cylinder 55*a* to stretch and retract the reach mechanism, the front rails 59 are moved forwardly and backwardly. A fork 57 is mounted on the fork carriage 52. The present embodiment having the above-mentioned arrangement the rear rails 58, as illustrated in FIG. 22, are mounted in respective inner masts 102 within a space 17 formed between a left and a right upright 1 so that the entire attachment comprising a reach type fork device is mounted so that it is located close to a truck body 2. As a result, the center of gravity of the attachment is located close to the truck body 2, permitting an increase in the permissible load. Thus, the loading capacity and the longitudinal stability of a lift truck are improved.

In addition, since the distance between the center of the front wheels 10 and the forward end of the front rail 59 can be reduced, the frontward view from the driver's seat is improved as compared with the known structure. Further, since the two lift cylinders 7 are separately and symmetrically disposed, the stability against an unbalanced load on the fork is enhanced.

FIGS. 23 through 27 illustrate still another embodiment wherein the present invention is applied to a lift truck having a reach type fork device as an attachment. An essential portion of the embodiment will be described below.

Also, in the present embodiment, in place of a single lift cylinder which is disposed between a left and a right upright 1 in the conventional arrangement, cylinders are disposed on both sides of a left and a right upright 1, especially at the rear of the respective uprights 1. Therefore, a space 17 is obtained between the left and the right upright 1, and a lift member 4 and a reach type fork attachment are disposed within the space as will be described in detail in the following. The lift member 4 is fixed to rear lower portions of a pair of left and right rear rails 58*a*. A connecting beam 60 is connected to the back faces of the respective rear rails 58*a* at respective positions intermediate thereof. The rear rails 58*a* are adapted to be lifted and lowered by respective lift cylinders while being guided by respective inner masts 102 through lift rollers 6 which are rotatably supported at the upper and lower portions of the outer faces of the respective rear rails 58*a*. A pair of left and right front rails 59*a* formed in channel shapes are arranged inside the respective rear rails 58*a*. An upper fork carriage 52 and a lower fork carriage 48 are fixed to forward lower portions of the respective front rails 59*a*. The front rails 59*a* are movable forwardly and rearwardly along a fore-and-aft axis of a lift truck relative to the respective rear rails 58*a* by a pantograph mechanism in the same manner as in the preceding embodiment. More specifically, four links 38*b* and 41*b* constituting a link mechanism are so arranged that pairs of each the two links are combined and rotatably connected by connecting pins 42*b* on the left and on the right, respectively. The links 38*b* located on the outer sides of the links 41 are rotatably connected, at their respective lower ends to corresponding support members 61*a* projected from the rear faces of the lower fork carriage 48 by pins 66*a*, and have at their respective upper ends, rolling rollers 68 rotatably mounted through shafts 67*a*, respectively. The rolling rollers 68 are received in the corresponding rear rails 58*a*, respectively. On the other hand, the links 41*b* located on the inner sides are bent inwardly at their respective lower ends and rotatably connected to support plates 71 projected from the rear face of the lift member 4 at a leftward and a rightward position by pins 72, respectively, and have at their respective upper ends rolling rollers 64 rotatably mounted through shafts 63*a* respectively. The rolling rollers 64 are received in the corresponding front rails 59*a*, respectively. The lower ends of the respective links 41*b* are connected by a connecting shaft 73 and the connecting shaft 73 in a reach mechanism is connected by a pin 74 and a bracket 75 to a tip end of a piston rod 56*b* of a reach cylinder 55*b* mounted at a forward central portion of the lift member 4 by a bracket 110 and a pin 111. Therefore, by actuating the reach cylinder 55*b* to stretch and retract the reach mechanism, the front rails 59*a* can be moved forwardly and backwardly.

In such an arrangement as mentioned above, the rear rails 58*a* are mounted inside the respective inner masts 102 and the front rails 59*a* are mounted inside the respective rear rails 58*a* so that the entire reach type fork device can be arranged so that it is located close to a truck body 2. This allows the center of gravity of the reach type fork device to be closer to the truck body 2 and the load center position to be closer to the truck body 2 as compared with a known arrangement wherein a fork carriage and an attachment are located in front of a mast. As a result, a reduction in the permissible load caused by the attachment device can be effectively avoided and the loading capacity and the longitudinal stability of the lift truck can be improved. In addition, since the distance between the center of the front tires and the forward end of the front rail 59*a* is reduced, the frontward view from the driver's seat can be improved as compared with the known structure, and since the two lift cylinders 7 are symmetrically and separately disposed, the stability against an unbalanced load can be increased.

Figure 28:
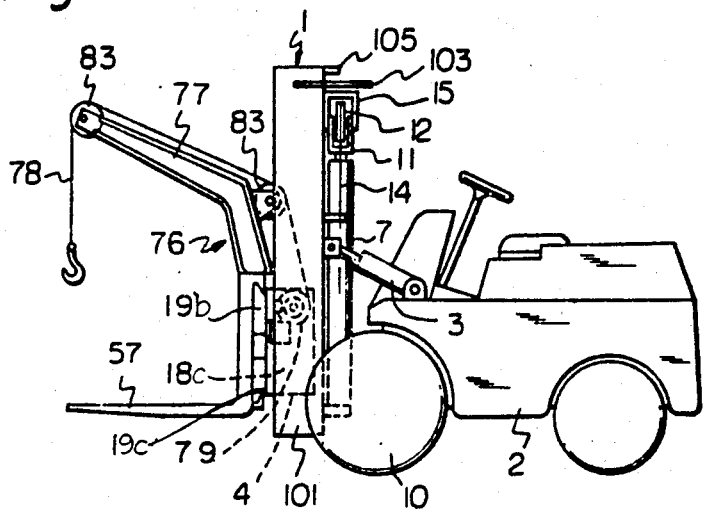
FIG. 28 is a side elevational view of a further embodiment of the present invention.
Figure 30:
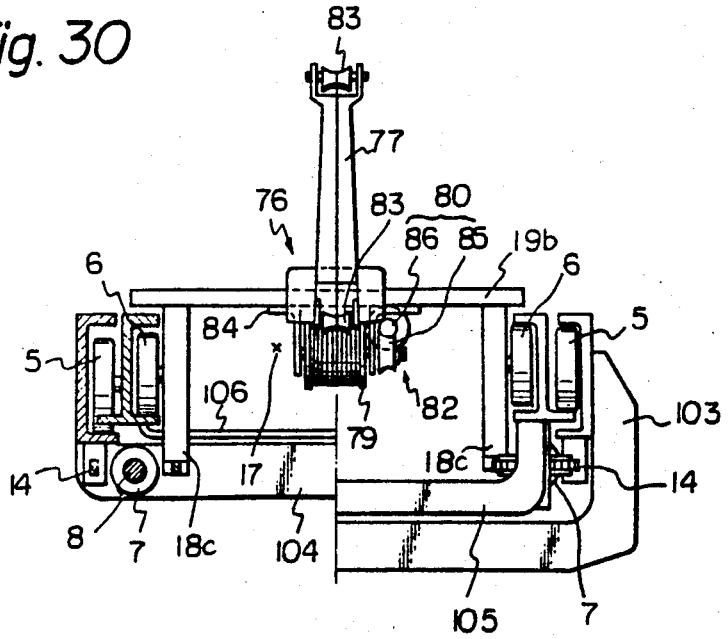
FIG. 30 is a partial sectional plan view of the essential part of the same embodiment.
Figure 29:
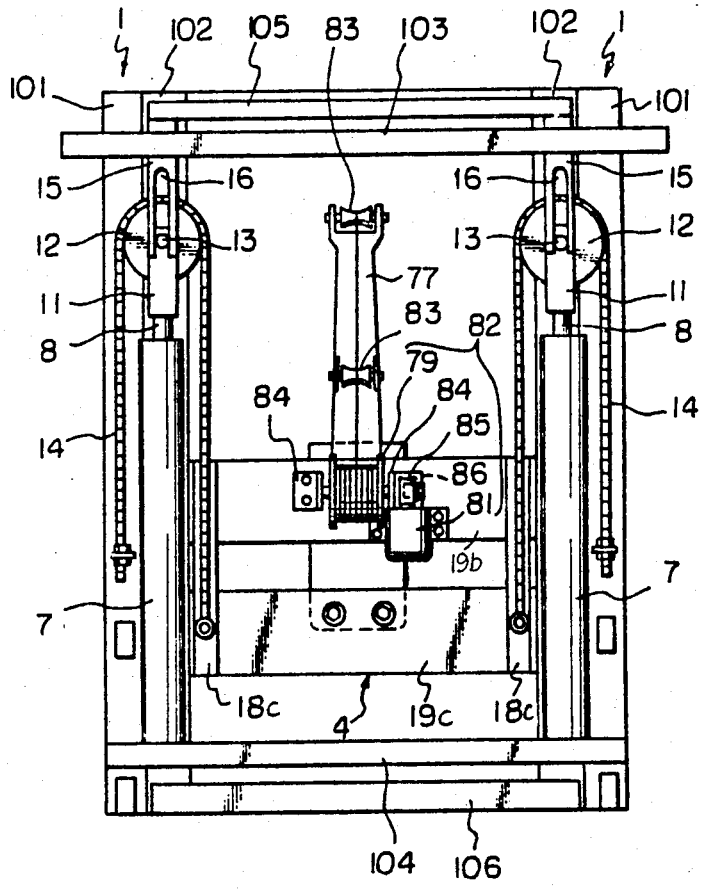
FIG. 29 is a front elevational view of an essential part of the same embodiment.
Figure 31:
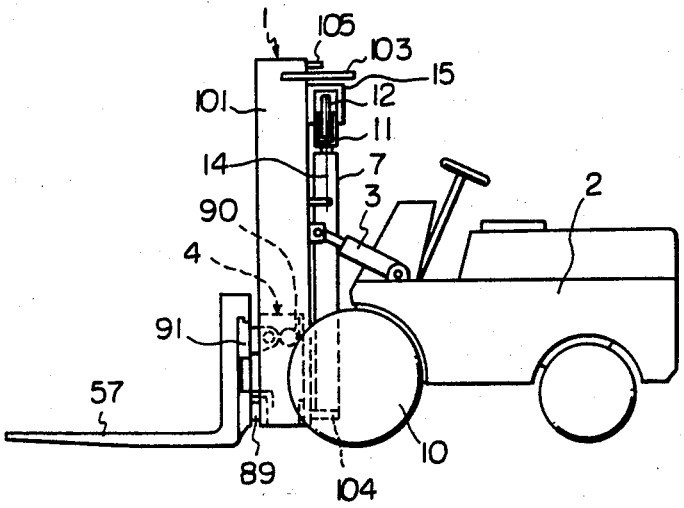
FIG. 31 is a side elevational view of a lift truck equipped with a load lifting unit in accordance with a further embodiment of the invention.
Figure 32:
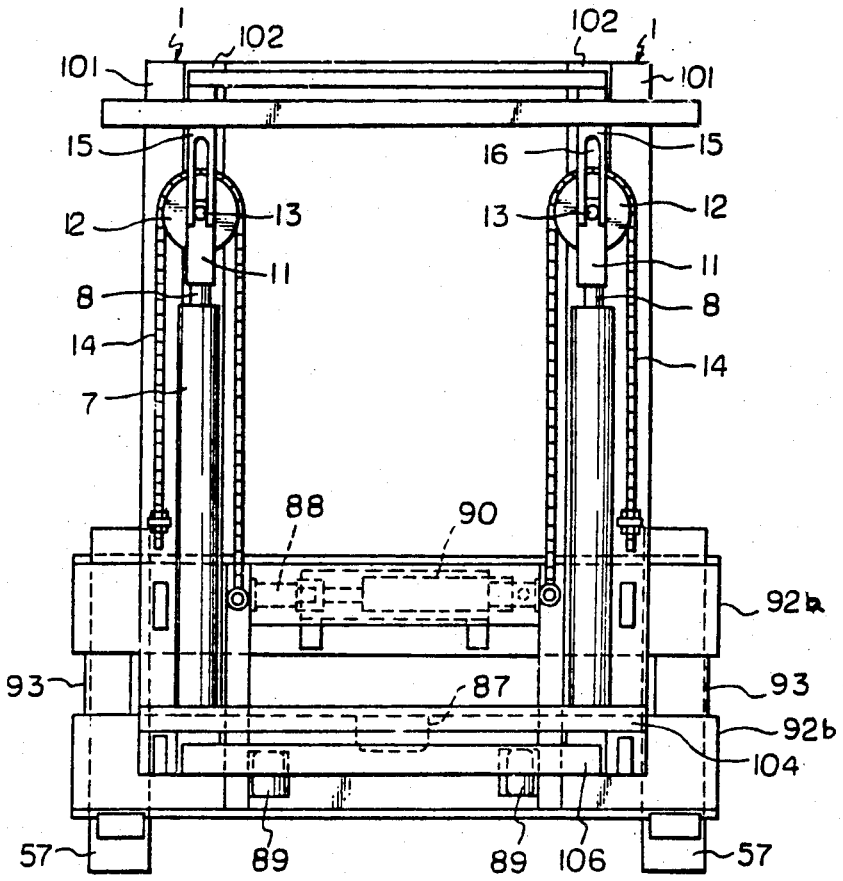
FIG. 32 is an elevational view of an essential part of the same embodiment.
Figure 33:
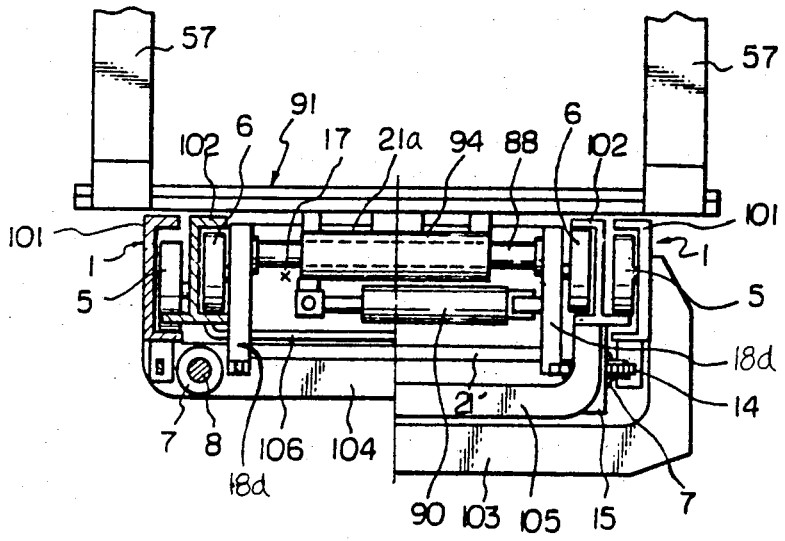
FIG. 33 is a plan view of the essential part of the same embodiment.

FIGS. 28 through 30 illustrate a load lifting unit employing a fork device with an winch as an attachment according to still another embodiment of the present invention. At this stage, reference will be made to a lift truck equipped with a fork device with a conventional winch. Load lifting components such as lift cylinder, a chain, etc. for lifting and lowering a lift member are disposed at a central portion between left and right uprights standing at forward portions of a truck body, and a winding means comprised of a winch drum used for a winch device, an oil motor, and a reduction gear are disposed at positions forward of the uprights so as not to interfere with the load lifting components. More specifically, the winding means is mounted on an upper back portion of a forwardly extending winch arm provided at a central portion of the lift member. Therefore, when an operator carries out a load lifting operation while watching the holding condition of the load, by the winch device, or the hanging state of the load by a tip end of a fork provided on the front face of the lift member, the load lifting components and the winding means such as the lift cylinder and the chain, arranged in front of the driver's seat obstructs the frontward view from the driver's seat, causing a reduction in the efficiency of the load lifting operation. In addition, since forward visibility is poor, it is dangerous to drive the lift truck.

A load lifting unit for a lift truck, in accordance with the present embodiment, provides a solution for such problems. This will be described in detail referring to FIGS. 28 through 30. Since a structure of an upright assembly and separate disposition of lift cylinders are similar to those in the foregoing embodiments, only essential portions of the present embodiment will be described in detail.

In the figures, a lift member 4 comprising a pair of left and right side plate members 18*c* having lift rollers 6 rotatably supported at upper and lower portions of the respective side plate members 18*c* and cross plate members 19*b* crossingly fixed to the front ends of the respective side plate members 18*c* is disposed within a space formed between a left and a right upright 1. The lift member 4 is adapted to be lifted and lowered by two lift cylinders 7 while being guided by inner masts 102 via the lift rollers 6.

The lift member 4 is provided with a winch device 76 and a fork 57. In this respect, the winch device 76 is mainly comprised of a winch arm 77, a winding portion 82 including a winch drum 79 for winding a cable 78 on the periphery thereof and an oil motor 81 connected to the winch drum 79 through a reduction gear 80, and guide rollers 83 for guiding the running of the cable 78. As illustrated in FIGS. 29 and 30, the winch arm 77 is mounted, at a base portion thereof on the front face of the front cross plate member 19*b* of the lift member 4. The winch arm 77 has the guide rollers 83 at an extended tip portion and a bent back portion, respectively. The winch drum 79 is rotatably supported by a bracket 84 fixed on the back of the front cross plate member 19*b* and has a worm wheel 85, an element of the reduction gear 80, fitted to a shaft end thereof. The oil motor 81 is also mounted on the back of the cross plate member 19*b* as is the winch drum 79 and has a worm 86, an element of the reduction gear 80, fitted to a shaft end thereof. The winch drum 79 is adapted to be driven at a reduced speed through engagement between the worm 86 and the worm wheel 85.

As is apparent from the foregoing description, in the present embodiment, the two lift cylinders 7 are disposed at the rear of the respective left and right uprights, and the lift member and the winding portion comprising the winch drum, the reduction gear and the oil motor are disposed within the space formed between the uprights so that the winding portion is accommodated at the back of the cross plate member within the space. This serves not only to improve the frontward view from the driver's seat, enhancing the efficiency of the load lifting operation, but also to locate the winding portion closer to the lower portion of the truck body, improving the longitudinal stability of the lift truck. Thus, there is provided an excellent effect in that the lift truck can be driven safely due to the improvement of the forward view.

FIGS. 31 through 34 illustrate a further embodiment wherein the present invention is applied to a load lifting unit for a lift truck fitted with a side shift fork as an attachment. The essential formation and the effects obtainable by the embodiment will be described below.

Figure 34:
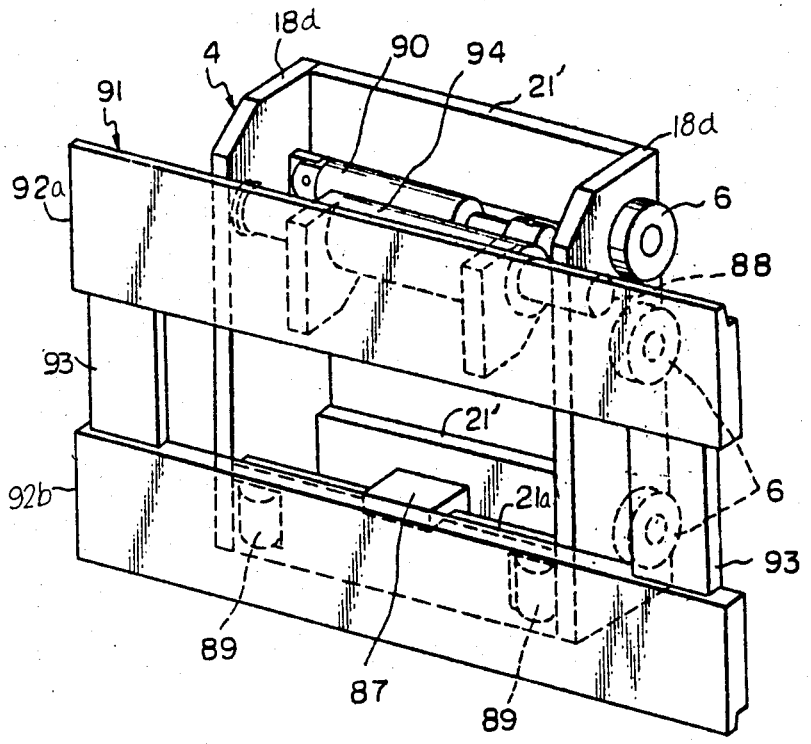
FIG. 34 is a perspective view of the same essential part.
Figure 35:
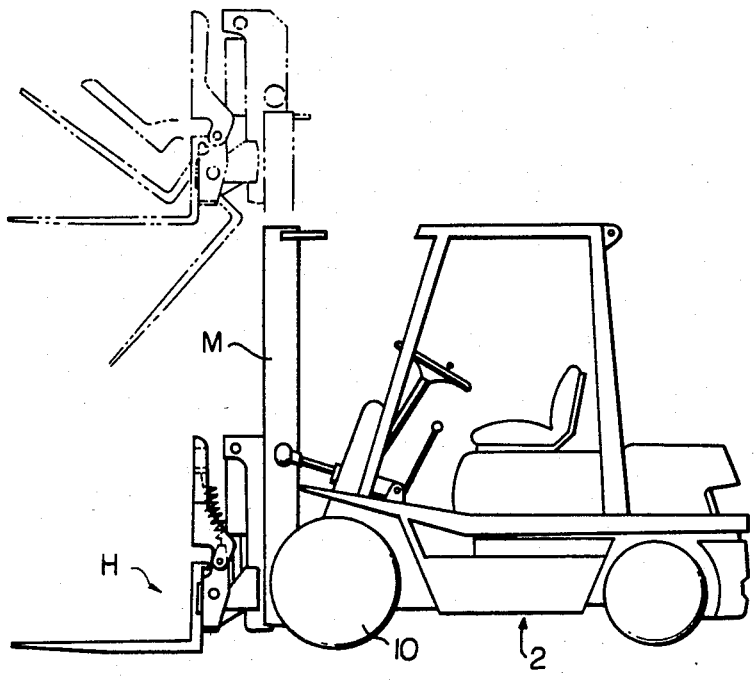
FIG. 35 is a side elevational view of an ordinary lift truck equipped with a hinged fork attachment.
Figure 36:
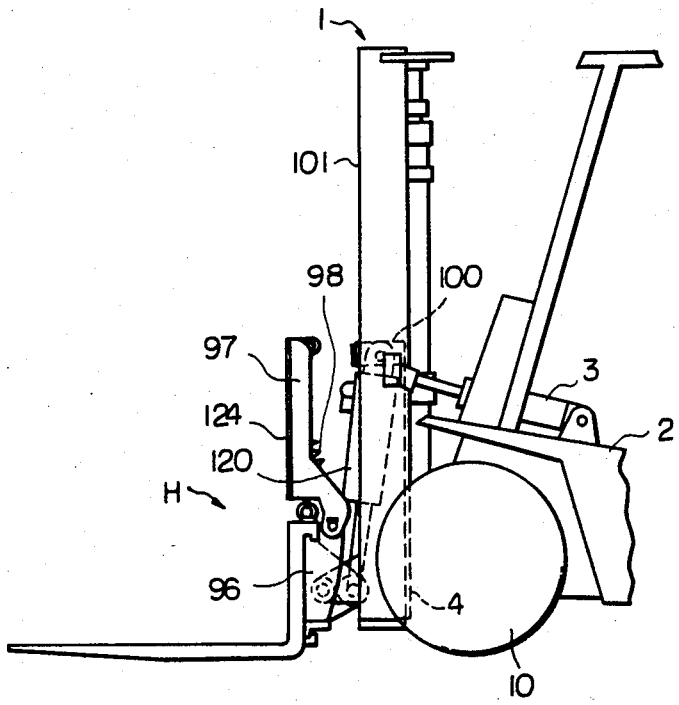
FIG. 36 is a fragmentary side view of a lift truck equipped with a hinged fork device in accordance with still a further embodiment of the invention.
Figure 37:
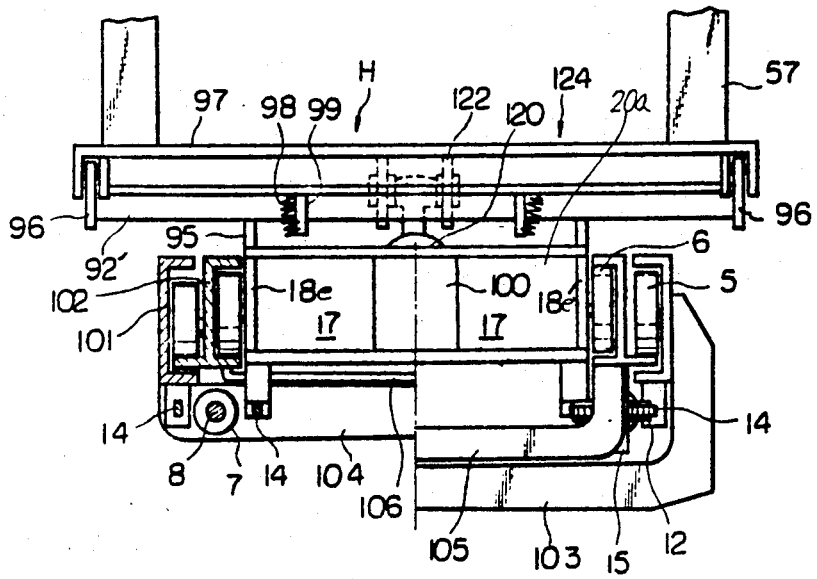
FIG. 37 is a partially cutaway plan view of an essential part of the same embodiment.
Figure 38:
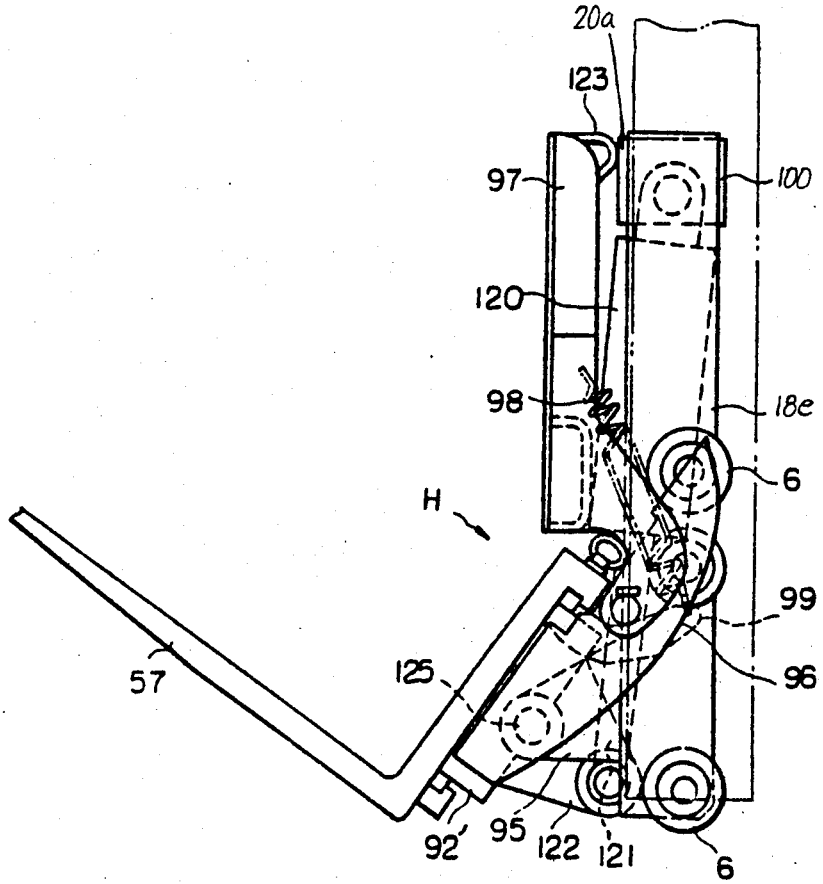
FIG. 38 is a side view of an essential part of the same embodiment.
Figure 39:
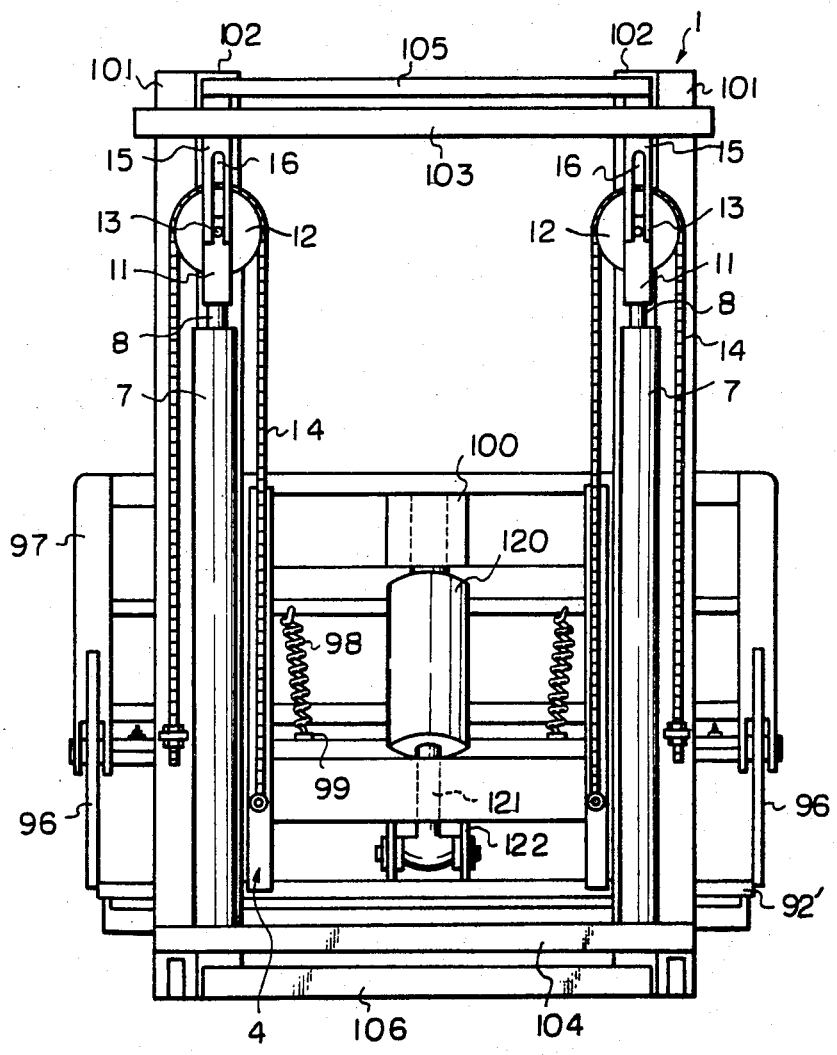
FIG. 39 is a front elevational view of an essential part of the same embodiment.
Figure 40:
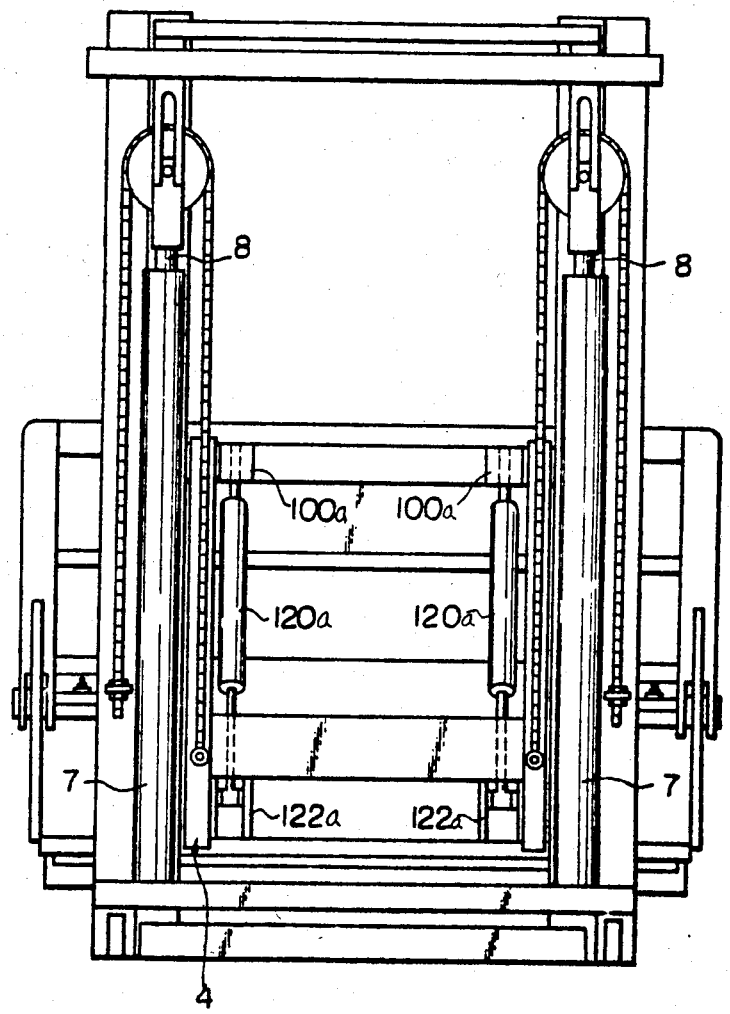
FIG. 40 is a front view of a modification of the essential part of the embodiment illustrated in FIGS. 36 through 39.

In the load lifting unit of the present embodiment, two lift cylinders 7 for lifting and lowering a lift member 4 are disposed at rear and side positions of respective left and right uprights 1 (they may be disposed outside of the uprights 1) and stand on a lower cross beam 104 of outer masts 101. Between the left and the right upright 1, there is formed a space 17. The lift member 4 is disposed within the space 17. The lift member 4 is mainly comprised, as illustrated in FIG. 34, of a pair of left and right side plates 18*d* each having lift rollers 6 rotatably supported on the outer face thereof, upper and lower back cross plates 21' crossingly fixed to the rear faces of the respective side plates 18*d* and a front cross plate 21*a* crossingly fixed to lower front portions of the respective side plates 18*d*. The lift member 4 further includes a horizontal shaft 88 as an upper guide member which slidably supports a fork bracket 91 and guide rollers 89 as lower guide members which are laterally rotatably arranged at the left and right ends of the front cross plate 21*a* and receive the lower back face of the fork bracket 91. Thus, the lift member 4 is adapted to be lifted and lowered by the above-mentioned lift cylinders 7, while being guided by inner masts 102 through the lift rollers 6.

A fork 57 is attached to the front face of the fork bracket 91.

The fork bracket 91 will now be described more specifically. As illustrated in FIG. 34, the fork bracket 91 is integrally formed of two upper and lower fork bars 92*a* and 92*b*, two left and right connecting bars 93 connected to the opposite ends of the respective upper and lower fork bars 92*a* and 92*b*, a holder 94 fixed to the back of the upper fork bar 92*a* and slidably supported by the horizontal shaft 88 of the lift member 4 and a stopper 87 fixed to the upper end of the lower fork bar 92*b* and engaged with the upper end of the front cross plate 21*a* of the lift member 4 for preventing forward and backward vibration. The fork bracket 91 is adapted to be shifted in a lateral direction of the lift truck by a shift cylinder 90 having a cylinder head and a piston rod end pivotally supported by the inner wall of the side plate 18*d* of the lift member 4 and by end portion of the holder 94.

As is apparent from the above-mentioned arrangement, the lift member is disposed in the space formed by arranging the two lift cylinders 7 at the rear of the respective left and right uprights, and the actuating mechanism comprising the guide members for guiding the sliding of the fork bracket of the side shift fork device and a hydraulic cylinder is also accommodated within the space. As a result, there are provided various substantial improvements in that the frontward view from the driver's seat is increased thereby enhancing the efficiency of the load lifting operation, and possible damage to the shift cylinder due to direct contact by the load if the load being handled collapses or falls is avoided. In addition, since the holder at the back of the fork bracket is disposed within the space, the spacing between the back of the fork bracket and the front of the uprights can be reduced to permit an increase in the load.

FIGS. 35 through 39 illustrate, a still further embodiment of the invention that is, a load lifting unit for a lift truck employing a hinged fork device as an attachment. In general, the hinged fork device is extremely heavy because it includes an actuating mechanism such as a cylinder means for tipping a fork member around a horizontal shaft. Therefore, when the hinged fork device is set at a forward portion of the body of a lift truck, the load center position is moved forwardly of the body of the lift truck. As a result, the permissible load, namely, the loading capacity of the lift truck, is considerably reduced and the longitudinal stability of the truck is reduced, which prohibits the optimum performance of the lift truck. The present invention eliminates such disadvantages. The essential structure and effects of the present embodiment will be described below.

In the present embodiment, two lift cylinders 7 are disposed at the rear of respective upright assemblies 1 so that a considerable space 17 is provided between the left and the right upright assemblies.

A hinged fork device H is provided with a load support member 124 held in front of a lift member 4 adapted to be lifted and lowered along the uprights 1. The lift member 4 is comprised of a pair of side plates 18*e* parallel with the upright means 1 and a top plate 20*a* connecting the upper ends of the respective side plates 18. The lift member 4 is disposed within the space 17 with lift rollers supported on the outer faces of the respective side plates 18*e* slidably engaged with respective inner masts 102. At the lower portions of the respective side plates 18*e* of the lift member 4, there is provided a pair of bracket members 95 so as to project forwardly. At the forward ends of the respective bracket member 95, the back portion of a fork carriage 92' constituting a part of the load support member 124 is connected by a shaft 125 so as to allow upward and downward rotation thereof.

The load support member 124 is comprised of the fork carriage 92', a fork 57 hanging from the fork carriage 92' and a back rest 97 supported by the fork carriage 92'. Arms 96 are provided at opposite ends of the fork carriage 92' so as to extend upwardly. The lower portion of the back rest 97 is pivotally supported at substantially the central portion of the arm 96, and the upper forward portion of the arm 96 abuts against the back of the back rest 97 to allow rotation of the back rest 97 only in a forward direction. A back rest spring 98 is anchored at one end thereof by the back rest 97 at an appropriate back position thereof and at another end by a spring arm 99 projected from the fork carriage 92'.

The top plate 20*a* of the lift member 4 is provided at a central position thereof with a cylinder bracket 100 by which the base end of a dump cylinder 120 is pivotally supported. A piston rod 121 extending from the cylinder 120 is connected at an end thereof to a rod bracket 122 projected rearwardly from the back of the fork carriage 92'. Upon actuation of the cylinder 120, the fork carriage 92' is adapted to be tipped around a pivotal shaft 125. In the figures, 123 is a stopper fixed to the back top portion of the back rest 97 and adapted to abut on the top plate 20*a* to stop excessive movement of the back rest 97 when the fork carriage 92' is tipped back and the back rest 97 is moved backwardly.

As mentioned above, the present embodiment is so structured that a pair of lift cylinders 7 are disposed at the rear of the respective uprights 1 each consisting of an inner mast 102 and an outer mast 101 so as to provide the space 17 between the left and the right uprights. Further, the lift member corresponding to a conventional dumping cylinder bracket located in front of an upright is disposed within the space and furthermore, the lift member is so formed that it supports, at the side portions thereof, lift rollers 5 engaging with the inner masts 102, supports, at the front portion thereof, the rotatable fork support portion and supports, at the upper portion thereof, the dump cylinder 120, thereby to arrange the load support member 124 equipped with the hinged fork attachment operating device H as near as possible in front of the uprights means 1. Therefore, the loading capacity of the lift truck can be increased. Moreover, since the entire hinged fork attachment operating device H is disposed closer to truck body 2, the distance between the center of the front tires and the back rest 97 can be reduced and since the lift cylinders 7 are disposed at the rear of the respective mast assemblies 1, a view of the tip of the fork from the driver's seat can be improved and the fork operation can be facilitated.

In addition, since the lift cylinders 7 are disposed so as to be located on the left and on the right, respectively, a stable load lifting operation is assured under an unbalanced load, and since the lift cylinders 7 and a piping member (not illustrated) are protected by the upright assemblies 1 from an obstruction in front of the lift truck or objects falling onto the truck, possible oil leakage or damage to a cylinder rod 10*a* can be avoided.

Although the explanation is made referring to the embodiment wherein one dump cylinder 120 for operating the hinged fork attachment operating device H is provided at a central portion of the lift member 4, the dump cylinder 120 may be taken out and alternately two separate cylinders may be disposed apart from each other and on the sides of the lift member 4 to further improve the frontward view from the central portion of the lift member 4.

Figure 43:
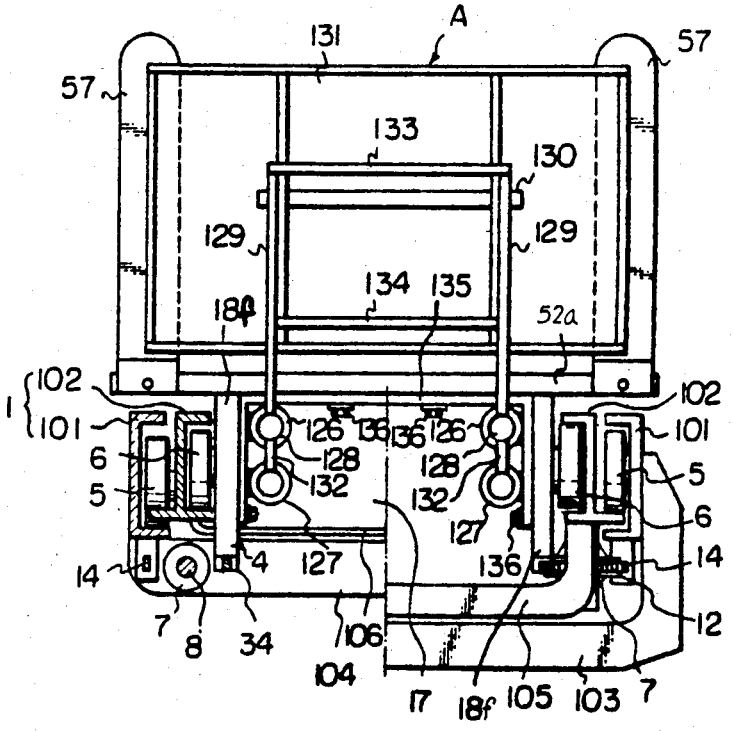
FIG. 43 is a half sectional plan view of a modification of the embodiment illustrated in FIGS. 41 through 42.

FIGS. 41 through 43 illustrate still further an embodiment wherein the present invention is applied to a load lifting unit for a lift truck equipped with a load stabilizer device as an attachment.

Generally, in the case of lift truck being equipped with a load stabilizer attachment, a forward end of a lift member is integrally extended forwardly of the body of a lift truck to obtain a space for mounting guide members and a stabilizer, which constitutes a part of the load stabilizer attachment, between the back of a fork carriage and uprights. More specifically, a pair of left and right guide members constituting a part of the load stabilizer attachment are fixed so as to be positioned at the back of the fork carriage, and a stabilizer cylinder is fixed so as to be positioned centrally at the back of the fork carriage. Therefore, in the fork lift truck equipped with the load stabilizer attachment, the fork carriage is inevitably located forwardly of the truck body, causing considerable reduction in the permissible load of a cargo.

The present embodiment provides a load lifting unit which is free from the aforesaid disadvantages.

The essential structure and operational effect of the present embodiment will be described in detail below, but a structure similar to that as mentioned above will not be referred to here for convenience sake.

In FIGS. 41 and 42, lift cylinders 7, are disposed at the rear of a left and a right upright 1 (they may be disposed outside of the uprights) respectively and stand on a lower cross beam 104 of outer masts 101 to form a space 17 in a region defined between the left and right uprights 1. Chain wheels 12 are rotatably supported by piston rods 8 of the respective lift cylinders 7 at tip ends thereof through wheel support members 11, respectively. A chain 14 fixed at one end thereof to the back of the outer mast 101 is fitted at an intermediate portion around the chain wheel 12. Side plate members 18*f* constituting a part of a lift member 4 which is adapted to be lifted and lowered along the uprights 1 are rotatably fitted in respective inner masts 102 through lift rollers 6 and have, at the front ends, a fork carriage 52*a* also constituting a part of the lift member disposed in front of the uprights 1. Numeral 24 represents chain anchoring pins provided on the back faces of the respective side plate members 18*f*, and the opposite ends of the chains 14 are fixed thereto. A load stabilizer attachment is mounted on the lift member 4. The load stabilizer attachment comprises a load stabilizer means A including a clamping plate 131, arm members 129 and columns 128, guide member 126 for supporting the stabilizer means A and controlling the lifting and lowering of the same, and stabilizer cylinders 127.

The guide member 126 and the cylinder 127 are fixed inside of respective side plate members 18*f* within a space 17 formed between the uprights 1 so as to align in a longitudinal direction. The arm member 129 which extends forwardly and substantially horizontally is fixed at a base portion thereof to the upper end of the column fitted in a guide portion of the guide member 126 for lifting and lowering and swingably supports the clamping plate 131 on the tip of the arm member 129, through a pin 130.

Numeral 132 is a connecting member connected at a tip end to the base end of the arm member 129 and connected at a base end to the tip end of a piston rod of the stabilizer cylinder 127. Numerals 133 and 134 are reinforcing members interconnecting the arm members 129, and 57 is a fork engaged with fork carriages 48*a* and 52*a*.

In the lift truck so structured as mentioned above, when the stabilizer cylinders 127 are actuated, the columns 128 fitted in the respective guide members 126 move up and down so that the clamping plate 131 is lifted and lowered through the arm members 129. By disposing the two lift cylinders 7, for lifting and lowering the lift member 4 at the rear and side positions or outer side positions of the respective outer masts 101 to provide the space 17 between the left and the right uprights and by fixing the guide members 126 which support the load stabilizer means A and the stabilizer cylinders 127 which control the up and down movement of the load stabilizer means A to the insides of the lift member 4 located within the space, the guide members 126 and the stabilizer cylinder 127 prevent the fork carriages 48*a* and 52*a* from being displaced forwardly. Further, the back faces of the fork carriages and the front faces of the uprights can be arranged as close as possible so as to effectively suppress a reduction in the permissible load caused by the mounting of the attachment and so as to highly improve the loading capacity of the fork lift and the longitudinal stability of the truck. Furthermore, since the guide members 126 and the stabilizer cylinders 127 are provided on the insides of the side plates 18*f* of the lift member 4 so as to be aligned in a longitudinal direction, there can be provided such significant advantages that the frontward view from the driver's seat is greatly improved, and the columns 128, guide members 126 and the stabilizer cylinders 127 are protected against possible damage.

The invention is not limited to the structure of this embodiment, and a structure wherein the arrangements of the guide members 126 and the stabilizer cylinders 127 are modified may also be employed. Besides, as illustrated in FIG. 43, there may be employed a structure wherein the guide members 126 and the stabilizer cylinders 127 are preliminarily fixed to a box-shaped bracket 135 which is fixed to the insides of the respective side plate members 18*f* and the backs of the respective fork carriages 48*a* and 52*a* by bolts 136.

This arrangement has the effect of greatly facilitating the mounting operation of the load stabilizer attachment on the fork lift.

Figure 44:
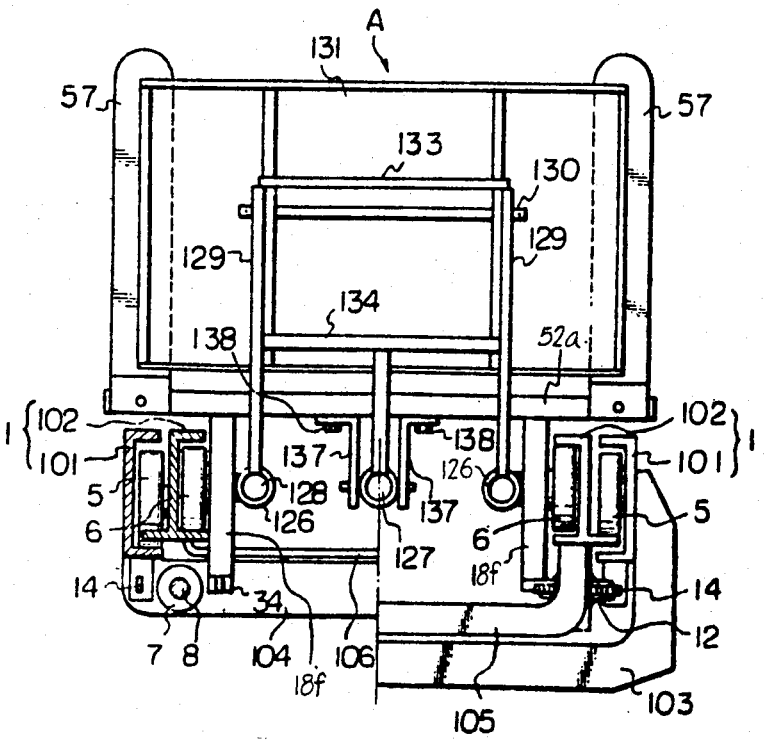
FIG. 44 is a similar half sectional plan view of a modification of the embodiment illustrated in FIGS. 41 and 42.

Further, alternatively, as illustrated in FIG. 44, there may be employed an arrangement in which the guide members 126 are fixed to the inside of the side plate members 18*f*, and a stabilizer cylinder 127 is fixed to the back of the fork carriage 52*a* by bolts 138 through a bracket 137. This arrangement is advantageous in that a single stabilizer cylinder suffices and therefore the manufacturing cost is reduced.

Although the invention has been explained referring to the preferred embodiments of the invention above, various modifications and changes may be carried out within the scope of the present invention as set forth in the claims.

We claim:

1. A lift truck comprising:

a truck body having a pair of front wheels on a front axle and a driver's seat disposed behind and above-said front wheels;

a pair of left and right uprights comprising a pair of left and right outer masts provided at front portions of said truck body of said lift truck, and a pair of left and right inner masts arranged to be moved up and down between and along said outer masts;

a lift member;

a lower beam disposed rearward of and extending laterally between the lower ends of said left and right outer masts;

two lift cylinders separately disposed adjacent to and rearward of said left and right uprights, respectively, for lifting and lowering said inner masts and said lift member relative to said outer masts, each of said two lift cylinders having a lower end mounted on said lower beam at the lower end of the corresponding outer mast within a respective area which is surrounded by said corresponding outer mast, said front axle and a corresponding one of said front wheels and within an angular range defined by the innermost point on the respective inner mast and the outermost point on the respective outer mast in the same horizontal plane as viewed from the driver's seat, such that obstruction of the view from the driver's seat of said lift truck by said uprights and said lift cylinders is minimized;

a pair of left and right brackets attached to said lower beam and enclosing the lower ends of said two lift cylinders;

left and right connecting members attached to said left and right brackets, respectively, and rotatably mounted on the front axle;

means for supporting said lift member in a space extending between said pair of left and right inner masts and said pair of left and right outer masts so that said lift member is capable of being moved up and down;

a load handling attachment carried by said lift member; and an actuating means arranged within said space for actuating said load handling attachment.

2. A lift truck as set forth in claim 1, wherein said lower beam includes a rising portion; and wherein said pair of left and right brackets are attached to said rising portion of said lower beam.

3. A lift truck as set forth in claim 2, wherein said left and right brackets are box-shape members, respectively, and enclose the corresponding lower ends of said two lift cylinders.

4. A lift truck as set forth in claim 1, wherein said lower ends of said two lift cylinders are mounted on said lower beam substantially at the same level as the lower ends of said left and right outer masts.

* * * * *